US008077890B2

(12) United States Patent
Schumaier

(10) Patent No.: US 8,077,890 B2
(45) Date of Patent: Dec. 13, 2011

(54) PREPROGRAMMED HEARING ASSISTANCE DEVICE WITH PROGRAM SELECTION USING A MULTIPURPOSE CONTROL DEVICE

(76) Inventor: Daniel R. Schumaier, Elizabethton, TN (US)

( * ) Notice: Subject to any disclaimer, the term of this patent is extended or adjusted under 35 U.S.C. 154(b) by 0 days.

(21) Appl. No.: 12/614,547

(22) Filed: Nov. 9, 2009

(65) Prior Publication Data

US 2010/0054510 A1 Mar. 4, 2010

Related U.S. Application Data

(63) Continuation-in-part of application No. 11/739,781, filed on Apr. 25, 2007, and a continuation-in-part of application No. 12/017,080, filed on Jan. 21, 2008, and a continuation-in-part of application No. 12/325,604, filed on Dec. 1, 2008, and a continuation-in-part of application No. 12/420,477, filed on Apr. 8, 2009.

(60) Provisional application No. 61/036,594, filed on Mar. 14, 2008.

(51) Int. Cl.
*H04R 25/00* (2006.01)

(52) U.S. Cl. ..... 381/314; 381/323

(58) Field of Classification Search ..... 700/94; 381/314, 323, 60; 307/139, 143
See application file for complete search history.

(56) References Cited

U.S. PATENT DOCUMENTS

| | | | |
|---|---|---|---|
| 4,972,487 | A | 11/1990 | Mangold et al. |
| 6,035,050 | A | 3/2000 | Weinfurtner et al. |
| 6,104,822 | A | 8/2000 | Melanson et al. |
| 6,674,867 | B2 | 1/2004 | Basseas |
| 6,741,712 | B2 | 5/2004 | Bisgaard |
| 6,748,089 | B1 | 6/2004 | Harris et al. |
| 6,785,394 | B1 | 8/2004 | Olsen et al. |
| 6,829,363 | B2 | 12/2004 | Sacha |
| 7,106,870 | B2 | 9/2006 | Meier et al. |

(Continued)

FOREIGN PATENT DOCUMENTS

| | | |
|---|---|---|
| EP | 1363473 | 11/2003 |
| EP | 1601232 | 11/2005 |
| WO | 9607295 | 3/1996 |

OTHER PUBLICATIONS

Harvey Dillon, Ph.D., Prescribing Hearing Aid Performance, 2001, 234-239, Chapter 9.

*Primary Examiner* — Davetta W Goins
*Assistant Examiner* — Daniel Sellers
(74) *Attorney, Agent, or Firm* — Luedeka, Neely & Graham, P.C.

(57) ABSTRACT

A user programmable hearing aid allows a user to select acoustical configuration programs that provide optimum performance for the user. The user may cycle through and evaluate various available programs by operating a single digital rocker switch on the hearing aid housing to switch from one program to the next. When a preferred program is active, the user can press and hold an up control or down control of the digital rocker switch for an extended time to select the currently active program. The user can then use the digital rocker switch to adjust the audio gain for the selected program. The hearing aid may also operate in a Configuration Mode wherein configuration settings may be changed by operating the up and down controls of the digital rocker switch. In the Configuration Mode, a clinician or patient may easily change configuration settings manually, with no need to connect the apparatus to a computer or other programming interface.

7 Claims, 14 Drawing Sheets

U.S. PATENT DOCUMENTS

2002/0015506 A1 2/2002 Aceti et al.
2004/0159535 A1 8/2004 Wagner
2005/0031145 A1 2/2005 Maltan et al.
2005/0111680 A1* 5/2005 Meier et al. ..... 381/314
2006/0029244 A1* 2/2006 Niederdrank ..... 381/312
2007/0286444 A1 12/2007 Heerlein et al.
2008/0170731 A1* 7/2008 Wojas ..... 381/312
2009/0003636 A1 1/2009 Heuermann et al.
2009/0196448 A1 8/2009 Schumaier

* cited by examiner

PREPROGRAMMED HEARING ASSISTANCE DEVICE WITH PROGRAM SELECTION USING A MULTIPURPOSE CONTROL DEVICE

This application is a continuation-in-part of and claims priority to U.S. patent application Ser. No. 11/739,781 filed Apr. 25, 2007, entitled "Preprogrammed Hearing Assistance Device with Program Selection Based on Patient Usage," U.S. patent application Ser. No. 12/017,080 filed Jan. 21, 2008, entitled "Preprogrammed Hearing Assistance Device with Program Selection Based on Patient Usage," U.S. patent application Ser. No. 12/325,604 filed Dec. 1, 2008, entitled "Preprogrammed Hearing Assistance Device with User Selection of Program," which claimed priority to provisional patent application Ser. No. 61/036,594 filed Mar. 14, 2008, entitled "User Programmable Hearing Assistance Device with Configuration Mode," and U.S. patent application Ser. No. 12/420,477 filed Apr. 8, 2009, entitled "Preprogrammed Hearing Assistance Device with Program Selection Using a Multipurpose Control Device."

FIELD

This invention relates to the field of hearing assistance devices. More particularly, this invention relates to a system for programming the operation of a hearing assistance device based on program selections made by a patient.

BACKGROUND

Hearing loss varies widely from patient to patient in type and severity. As a result, the acoustical characteristics of a hearing aid must be selected to provide the best possible result for each hearing impaired person. Typically, these acoustical characteristics of a hearing aid are "fit" to a patient through a prescription procedure. Generally, this has involved measuring hearing characteristics of the patient and calculating the required amplification characteristics based on the measured hearing characteristics. The desired amplification characteristics are then programmed into a digital signal processor in the hearing aid, the hearing aid is worn by the patient, and the patient's hearing is again evaluated while the hearing aid is in use. Based on the results of the audiometric evaluation and/or the patient's comments regarding the improvement in hearing, or lack thereof, an audiologist or dispenser adjusts the programming of the hearing aid to improve the result for the patient.

As one would expect, the fitting procedure for a hearing aid is generally an interactive and iterative process, wherein an audiologist or dispenser adjusts the programming of the hearing aid, receives feedback from the patient, adjusts the programming again, and so forth, until the patient is satisfied with the result. In many cases, the patient must evaluate the hearing aid in various real world situations outside the audiologist's or dispenser's office, note its performance in those situations and then return to the audiologist or dispenser to adjust the hearing aid programming based on the audiologist's or dispenser's understanding of the patient's comments regarding the patient's experience with the hearing aid.

One of the significant factors in the price of a hearing aid is the cost of the audiologist's or dispenser's services in fitting and programming the device, along with the necessary equipment, such as software, computers, cables, interface boxes, etc. If the required participation of the audiologist and/or dispenser and the fitting equipment can be eliminated or at least significantly reduced, the cost of a hearing aid can be significantly reduced.

The complexity and cost of fitting hearing assistance devices in general also applies in the fitting of tinnitus masking devices. Tinnitus is a condition wherein a person experiences a sensation of noise (as a ringing or roaring) that is caused from a condition, such as a disturbance of the auditory nerve, hair cells, temporal mandibular joint or medications, to name a few. Tinnitus is a significant problem for approximately 50 million people each year, and some people only find relief with tinnitus maskers. A tinnitus masker looks like a hearing aid, but instead of amplifying sensed sound, it produces a sound, such as narrow-band noise, that masks the patient's tinnitus. Some of these instruments have a trim pot that is used to change the frequency of the masking noise. Such instruments may also have a volume control so the user may select the intensity of the masking that works best.

Most tinnitus maskers are prescribed to patients who do not have significant hearing loss, and the masking sound is designed to be more acceptable to the patient than the tinnitus. For most patients that have significant hearing loss, hearing aids can also provide tinnitus relief. However, there are some patients that need both amplification and tinnitus masking.

The most appropriate masking stimuli to be generated by a tinnitus masker is usually determined by an audiologist or dispenser during a fitting procedure. Like the fitting of a hearing aid, the fitting procedure for a tinnitus masker also tends to be an iterative process which significantly increases the overall cost of the masking device.

What is needed, therefore, is a programmable hearing assistance device that does not require a fitting procedure conducted by an audiologist or dispenser. To obviate the necessity of the programming equipment and the necessity of an audiologist or dispenser fitting procedure, a programmable hearing assistance device is needed which is automatically programmed based on selections made by a patient while using the device or based on usage patterns of the patient. This need applies to hearing aids as well as to tinnitus masking devices.

SUMMARY

The above and other needs are met by programmable apparatus for improving a person's perception of sound. In one embodiment, the apparatus includes a housing configured to be worn in, on or behind an ear of the person. Disposed within the housing is memory, a processor, a multipurpose control device, a digital-to-analog converter and an audio output section. The memory stores available audio processing programs that may be used in processing digital audio signals. The processor is operable to execute one or more of the available audio processing programs to process the digital audio signals. The multipurpose control device, which may be a digital rocker switch, can be used in a program switching mode or in a volume control mode. In the program switching mode, the user may operate the multipurpose control device to switch between the available audio processing programs. In the volume control mode, the user may operate the multipurpose control device to adjust the volume of audible sound generated by the audio output section. Combining these functions in one control device simplifies operation and reduces the number of needed control devices.

In some embodiments, the apparatus also includes a battery compartment door attached to the housing and a contact switch that changes state based on opening or closing the battery compartment door. The processor of these embodiments is also operable in a configuration mode for changing configuration settings of the programmable apparatus. The processor enters the configuration mode when the contact switch of the battery compartment door indicates the battery compartment door is moved from an open position to a closed position while the multipurpose control device is continuously operated by the person for a predetermined time. When the processor is in the configuration mode, the multipurpose control device may be operated by the person to change configuration settings of the programmable apparatus.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
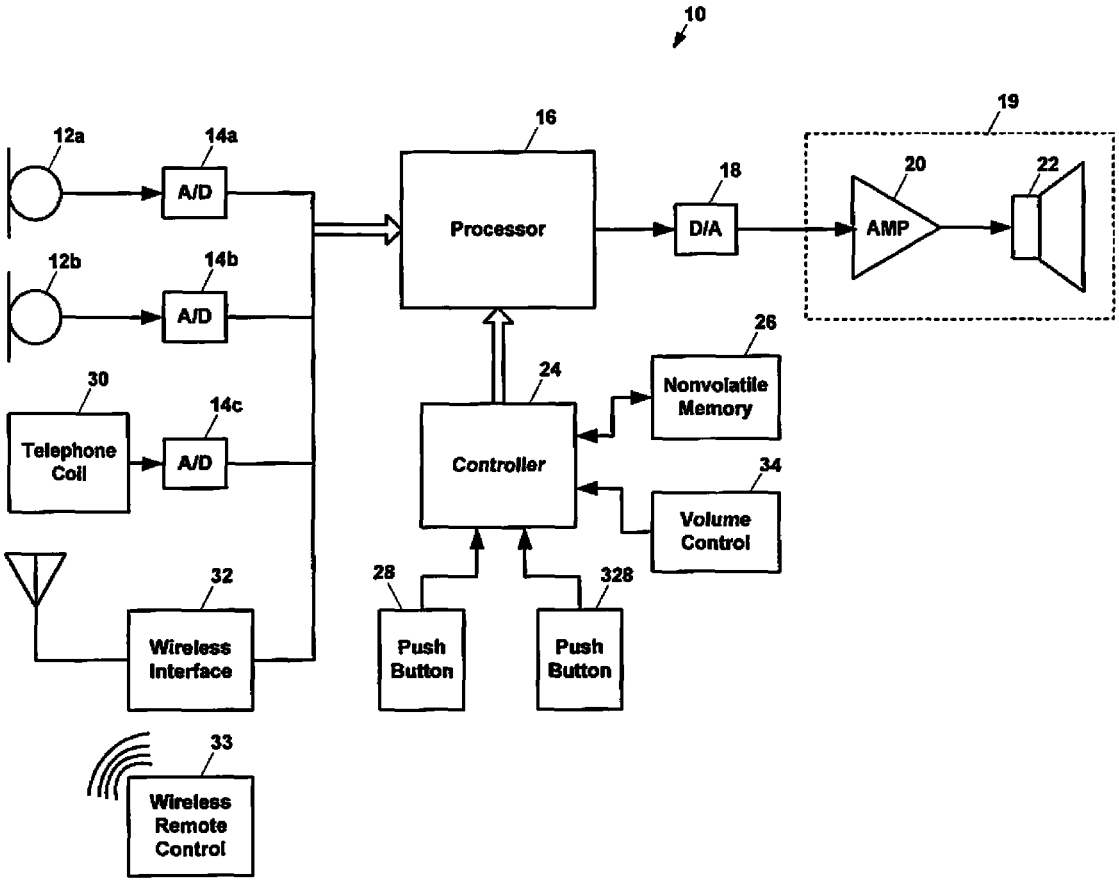
FIG. 1 depicts a functional block diagram of a hearing assistance device according to an embodiment of the invention.
Figure 6:
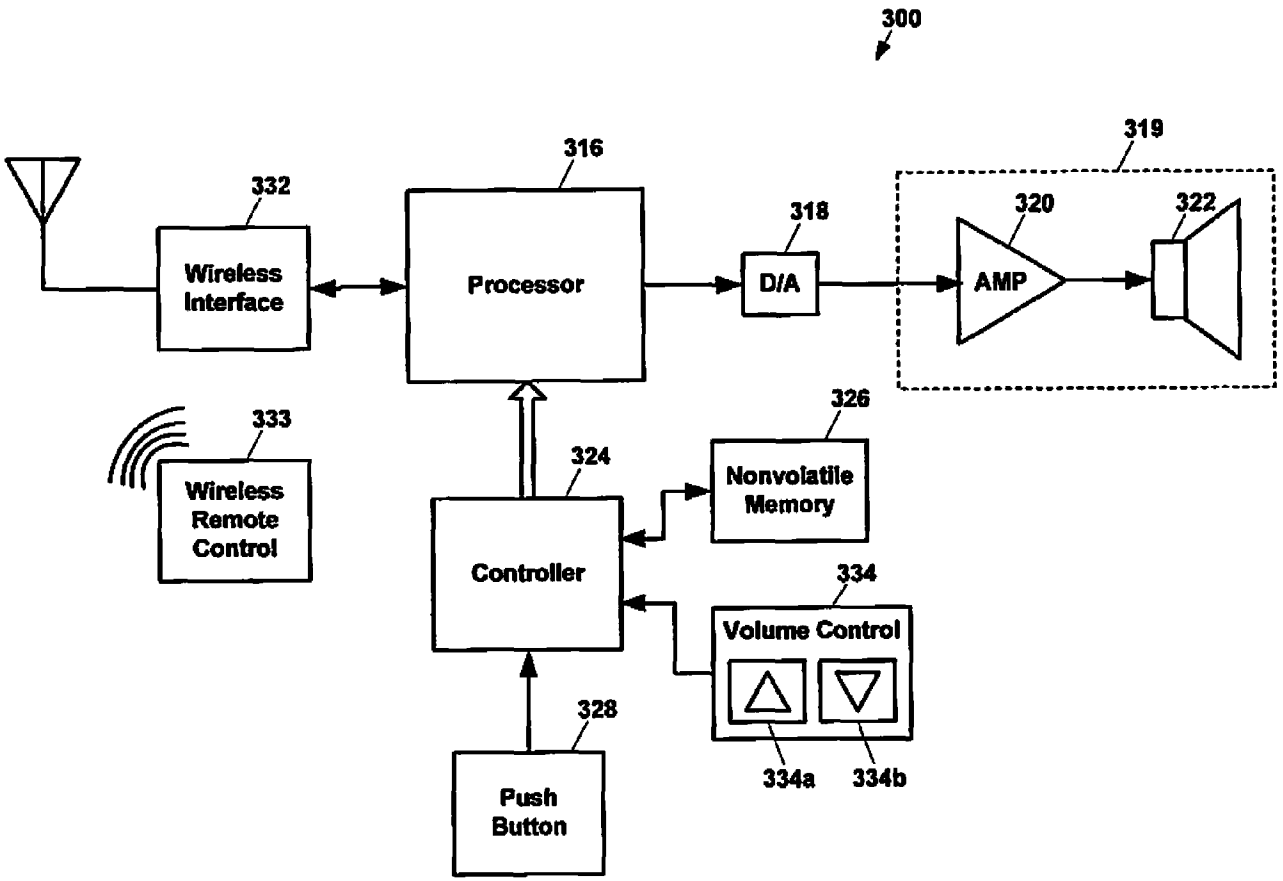
FIG. 6 depicts a functional block diagram of a tinnitus masking device according to an embodiment of the invention.
Figure 11:
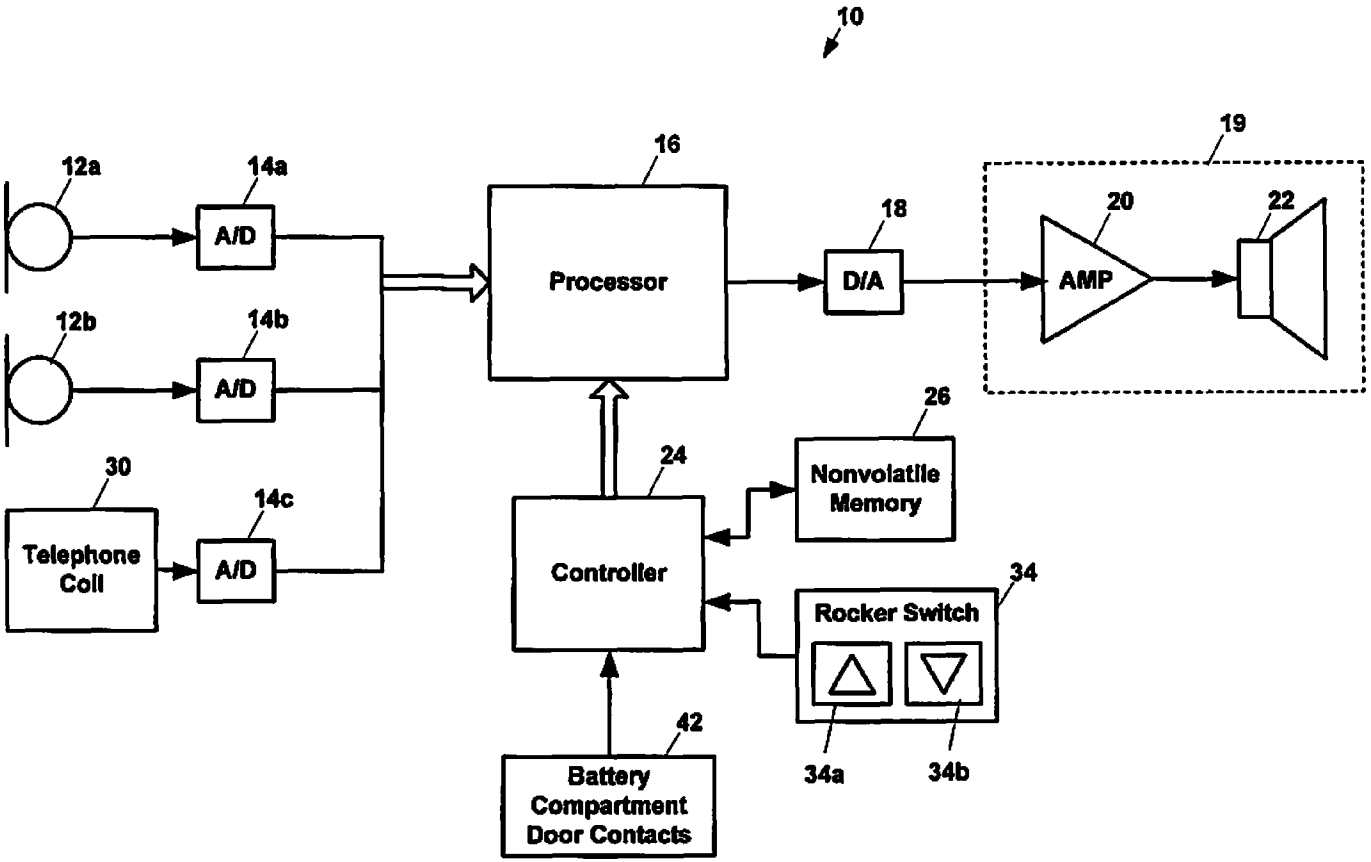
FIG. 11 depicts a functional block diagram of a hearing assistance device according to an embodiment of the invention.

FIGS. 1 and 11 depict embodiments of a hearing assistance device 10 for improving the hearing of a hearing-impaired patient. The device 10 of FIGS. 1 and 11 is also referred to herein as a hearing aid. Another embodiment of a hearing assistance device is a tinnitus masking device as shown in FIG. 6 which is discussed in more detail hereinafter.

In the following description of various embodiments of the invention, certain manual operations are described as preferably being performed by a wearer (or user or patient), and certain manual operations are described as preferably being performed by an audiologist (or clinician or dispenser). However, it will be appreciated that the wearer or audiologist or both may perform any of the manual operations described herein, and that the invention is not limited to any particular person's contribution to the performance of these operations.

As shown in FIGS. 1 and 11, the hearing assistance device 10 includes one or more microphones 12*a-b* for sensing sound and converting the sound to analog audio signals. The analog audio signals generated by the microphones 12*a-b* are converted to digital audio signals by analog-to-digital (A/D) converters 14*a*-14*b*. The digital audio signals are processed by a digital processor 16 to shape the frequency envelope of the digital audio signals to enhance those signals in a way which will improve audibility for the wearer of the hearing assistance device. Further discussion of various programs for processing the digital audio signals by the processor 16 is provided below. Thus, the processor 16 generates digital audio signals that are modified based on the programming of the processor 16. The modified digital audio signals are provided to a digital-to-analog (D/A) converter 18 which generates analog audio signals based on the modified digital audio signals. The analog audio signals at the output of the D/A converter 18 are amplified by an audio amplifier 20, where the level of amplification is controlled by a control device 34, such as a digital volume control, coupled to a controller 24. The amplified audio signals at the output of the amplifier 20 are provided to a sound generation device 22, which may be an audio speaker or other type of transducer that generates sound waves or mechanical vibrations which the wearer perceives as sound. The amplifier 20 and sound generation device 22 are referred to collectively herein as an audio output section 19 of the device 10.

In the embodiment of the invention depicted in FIG. 11, the control device 34 comprises a digital rocker switch mounted on an outer surface of a housing 50 of the device 10. For example, the digital rocker switch 34 may be a model number MT90 Momentary Toggle Switch manufactured by Sonion. In some embodiments, the control device 34 comprises two individual push button switches disposed in a single rocker-style switch housing. Both of these control device configurations are referred to herein as a digital rocker switch and both include "up" and "down" controls 34*a* and 34*b*. The digital rocker switch 34 is also referred to herein as a multipurpose control device because it may be used as a volume control and as a control for switching between available audio processing programs. As described in more detail below, it may also be used in a configuration mode to change various configuration settings of the device 10. As also described in more detail below, the up and down controls 34*a*-34*b* of the rocker switch 34 may be used in conjunction with battery compartment door contacts 42 (FIG. 11) to enter and exit the configuration mode.

With continued reference to FIGS. 1 and 11, some embodiments of the invention include a telephone coil 30. The telephone coil 30 is small coil of wire for picking up the magnetic field emitted by the ear piece of some telephone receivers or loop induction systems when the hearing assistance device 10 is disposed near such a telephone receiver or loop induction system. Signals generated by the telephone coil 30 are converted to digital signals by an A/D converter 14*c* and are provided to the processor 16. As discussed in more detail below, the converted digital signals from the telephone coil 30 may be used in some embodiments of the invention for resetting or reprogramming the processor 16, or controlling the operation of the hearing assistance device 16 in other ways.

Some embodiments of the invention also include a wireless interface 32, such as a Bluetooth interface, for receiving wireless signals for resetting or reprogramming the processor 16. In some embodiments, the wireless interface 32 is also used to control the operation of the device 10, including selection of acoustical configuration programs or masking stimuli programs. The wireless interface 32 may also be used to wirelessly deliver an audio signal to the device 10, such as a music signal transmitted from a wireless transmitter attached to a CD player, or the audio portion of a television program transmitted from a wireless transmitter connected to a television tuner. In various embodiments, the wireless interface 32 comprises a WiFi link according to the IEEE 802.11 specification, an infrared link or other wireless communication link.

As shown in FIG. 1, a manually operated input device 28, also referred to herein as a momentary switch or push button, is provided in some embodiments for enabling the wearer to control various aspects of the operation and programming of the hearing assistance device 10. The push button 28 is preferably very small and located on an outer surface of the hearing aide housing in a location that is easily accessible to the wearer while the wearer is using the device 10.

For example, the device 10 may be configured as a behind-the-ear (BTE) instrument, with the push button 28 located on an accessible surface of the housing 50 of the BTE instrument. An example of a hearing aid having BTE and in-the-ear (ITE) portions is described in U.S. Patent Application Publication 2006/0056649, where reference number 34 of FIG. 1 of that publication indicates one possible location for a push button switch on the BTE portion of a hearing aid. The push button 28 may also be located on the ITE portion. It will be appreciated that the invention is not limited to any particular configuration of the device 10. In various embodiments, the device 10 may comprise an open fit hearing aid, a canal hearing aid, a half-shell configuration, a BTE device, an ITE device or a completely in canal (CIC) device.

The push button 28 is electrically connected to a controller 24 which generates digital control signals based on the state (open or closed) of the switch of the push button 28. In a preferred embodiment of the invention, the digital control signals are generated by the controller 24 based on how long the push button 28 is pressed. In this regard, a timer is included in the controller 24 for generating a timing signal to time the duration of the pressing of the button 28. Further aspects of the operation of the controller 24 and the push button 28 are described in more detail below.

A second push button 328 may be included in embodiments of the invention that combine hearing aid functions with tinnitus masking functions. In these embodiments, a push button 328 is used to control the selection of tinnitus masking programs as described in more detail hereinafter. Alternatively, a single push button may be used for first programming the hearing aid functions and then programming the tinnitus masking functions.

Nonvolatile memory 26, such as read-only memory (ROM), programmable ROM (PROM), electrically erasable PROM (EEPROM), or flash memory, is provided for storing programming instructions and other operational parameters for the device 10. Preferably, the memory 26 is accessible by the processor 16 and/or the controller 24.

According to preferred embodiments of the invention, the hearing assistance device 10 is operable in several different modes as determined by its programming. As the terms are used herein, "programs" and "programming" refers to one or more sets of instructions that are carried out by the processor 16 in shaping the frequency envelope of digital audio signals to enhance those signals to improve audibility for the wearer of the hearing assistance device 10. "Programs" and "programming" also refers to the instructions carried out by the processor 16 in determining which of several stored enhancement programs provides the best improvement for the wearer.

FIGS. 2-5 depict the process flow of some exemplary methods for selecting the most effective hearing enhancement program for the wearer.

Figure 2:
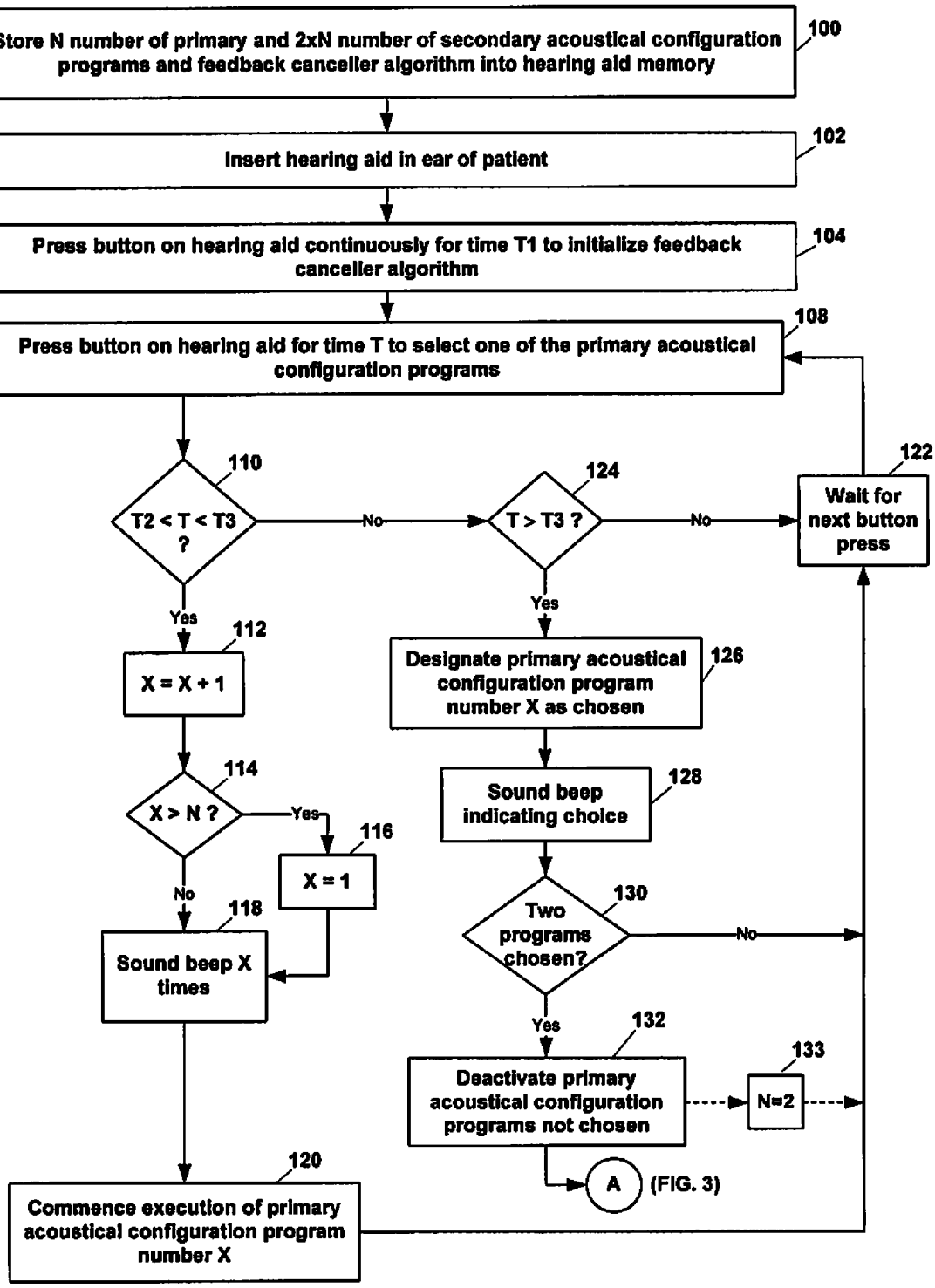
FIGS. 2 and 3 depict a functional flow diagram of the programming of a hearing assistance device according to an embodiment of the invention.
Figure 3:
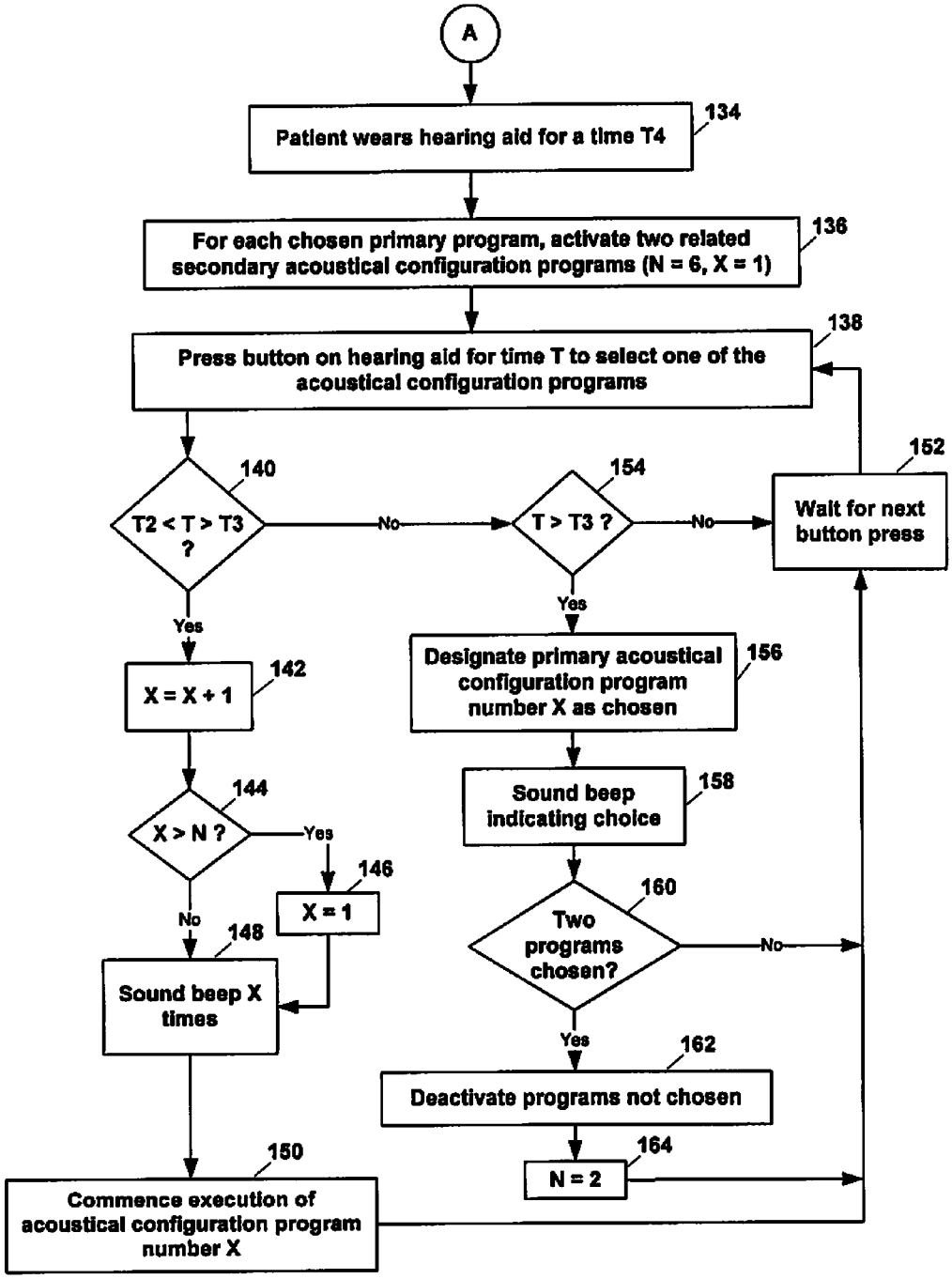

FIGS. 2 and 3 depict a process flow according to one preferred embodiment of the invention wherein the selection of the most effective enhancement program is based upon a "trial and error" interactive and iterative method, where the wearer of the device evaluates several options for enhancement programs and chooses one or more programs that provide the best enhancement for the individual wearer. As shown in FIG. 2, a first step in the method is to store in memory 26 some number (N) of primary acoustical configuration programs for shaping the acoustical characteristics of the hearing assistance device 10 (step 100). This step may be performed at the time of manufacture of the hearing assistance device 10 or at a later time, such as during a reprogramming procedure. In a preferred embodiment of the invention, seven primary acoustical characteristic configuration programs are loaded into the memory 26 (N=7). However, it will be appreciated that any number of programs may be initially loaded into memory 26, and the invention is not limited to any particular number.

As the phrases are used herein, a "primary acoustical characteristic configuration program" or a "initial-tuning program" is an algorithm that sets the audio frequency shaping or compensation provided in the processor 16. These programs or algorithms may also be referred to by audiologists or dispensers as "gain-frequency response prescriptions." Examples of generally accepted primary acoustical configuration programs include NAL (National Acoustic Laboratories; Bryne & Tonisson, 1976), Berger (Berger, Hagberg & Rane, 1977), POGO (Prescription of Gain and Output; McCandless & Lyregaard, 1983), NAL-R (NAL-Revised; Byrne & Dillon, 1986), POGO II (Schwartz, Lyregaard & Lundh, 1988), NAL-RP (NAL-Revised, Profound; Byrne, Parkinson & Newall, 1991), FIG. 6 (Killion & Fikret-Pass, 1993) and NAL-NL1 (NAL nonlinear; Dillon, 1999). It will be appreciated that other primary acoustical configuration programs or initial-tuning programs could be used in association with the methods described herein, and the above list should not be construed as limiting the scope of the invention in any way.

A "secondary acoustical characteristic configuration program" or a "fine-tuning program" as those phrases are used herein refer to a variation on one of the primary programs or initial-tuning programs. For example, in one of the primary programs or initial-tuning programs, a parameter for gain at 1000 Hz may be set to a value of 20 dB which is considered to be in or near the center of a range for an average hearing loss patient. In an example of a related secondary program or fine-tuning program, the parameter for gain at 1000 Hz may be set to a value of 25 dB which is just above the "standard" value. Accordingly, another related secondary program or fine-tuning program may have the parameter for gain at 1000 Hz set to a value of 15 dB which is just below the "standard" value. There may be any number of secondary programs or fine-tuning programs that include various variations of parameters which in the associated primary program or initial-tuning program are set to a standard or average value. Preferably, 2×N number of secondary acoustical configuration programs are loaded into memory at step 100. For example, there may be two secondary programs associated with each primary program.

In the preferred embodiment of the invention, a feedback canceller algorithm is also stored in the memory 26 of the device 10. An example of a feedback canceller algorithm is described in U.S. Patent Application Publication 2005/

0047620 by Robert Fretz. As described in more detail below, such an algorithm is used to set the acoustical gain levels in the processor 16 and/or the amplifier 20 to avoid audio feedback in the device 10.

At some point after the initial programming of the device (step 100), a wearer inserts the device 10 into the ear canal (in the case of an ITE device) or places the device 10 behind the ear (in the case of a BTE device) with the associated connections to the ear canal (step 102). Once the device 10 is in position, the wearer presses the button 28 for some extended period of time T1, such as 60 seconds, to activate the device 10 and initialize the feedback canceller program (step 104). According to a preferred embodiment of the invention, the feedback canceller program generates and stores acoustical coefficients that will be applicable to all of the primary and secondary acoustical configuration programs stored in the memory 26.

Once the feedback canceller program has performed its initialization procedure, the wearer can cycle through the N number of available primary acoustical configuration programs and try each to determine which provides the best enhancement for the wearer's hearing loss. The wearer does this by pressing the button 28 for at least some period of time T2, such as one second, to switch from one program to the next (step 108). For example, a first program may be executed by the processor 16 when the device 10 is first powered on. When the wearer presses the button 28 for at least one second, a second program is executed by the processor 16 (step 120). In some embodiments, the device 10 generates two beeps (step 118) to indicate to the selection of the second program. When the wearer presses the button 28 again for at least one second, a third program is executed by the processor 16 (step 120) and the device 10 generates three beeps to indicate that the third program is selected. This continues until the wearer has cycled through the N number of programs (such as seven). If the wearer presses the button 28 again for at least one second, the first program is loaded again. This process is represented by steps 108-122 of FIG. 2. To cycle through programs quickly, the wearer may press the button 28 several times consecutively until the desired program is selected. At this point, some number of beeps are generated to indicate which program is selected.

If it is determined that the button 28 is pressed for less than one second (step 110), then no new program is loaded and the process waits for the next button press (step 122). This prevents inadvertent switching from one program to the next due to an accidental press of the button 28.

Once the wearer has had a chance to evaluate all of the available primary programs, the wearer may find that some smaller number of the programs, such as two, seem to be used most because they provide the best hearing enhancement for the user in various situations. For example, one of the programs may provide the best performance in normal quiet conversation settings. Another of the programs may provide the best performance in a noisy setting, such as in a crowded room. A preferred embodiment of the invention allows the user to eliminate programs that are not used or rarely used, and to evaluate some secondary programs that are variations on the best performing programs. As described below, this is accomplished by pressing the push button 28 for a time T3, such as 30 seconds, which is longer than the time T2.

As shown in FIG. 2, if it is determined that the button 28 is pressed for a time T3 or longer (step 124), such as 30 seconds, the processor 16 sets a flag or stores a value indicating that the currently-loaded primary program has been designated as a chosen program (step 126). At this point, the device 10 generates a distinctive sound (step 128) to indicate to the wearer that a program has been chosen. In a preferred embodiment, the device 10 allows the user to choose two of the N number of primary acoustical configuration programs. However, it will be appreciated that the device 10 could accommodate designation of more or fewer than two primary acoustical configuration programs as chosen. If it is determined at step 130 that two programs have not yet been chosen, the process waits for the next press of the button 28 (step 122).

In an alternative embodiment of the invention, instead of pressing the button 28 to choose a program, the wearer presses the button 28 for at least time T3 to deactivate a non-chosen program. Thus, it will be appreciated that the invention is not limited to the manner in which programs are designated as chosen or not chosen.

If it is determined at step 130 that two primary acoustical configuration programs have been chosen, then the primary programs that have not been chosen are deactivated (step 132 in FIG. 3). Deactivation in this sense means that the non-chosen programs are made unavailable for selection and execution using the procedure of repeated pressing of the button 28. Thus, at this point, two primary programs are available for selection and execution.

After the wearer has used the device 10 for some extended period of time T4 (step 134), such as 80 hours, two secondary acoustical configuration programs are activated for each of the prioritized primary programs. For example, if two primary programs have been chosen by way of the user selection process of steps 124-130, then four secondary programs are activated at step 136, resulting in a total of six available programs (N=6). Activation of a program in this sense means to make a program available for selection and execution. In a preferred embodiment of the invention, each of the two newly-added secondary programs are variations on a corresponding one of the chosen primary programs. This allows the wearer to make a more refined selection so as to "fine tune" the desired acoustical response. At this point in this example, the wearer has six available programs to evaluate and the user can cycle through the six programs using the button pressing procedure depicted in steps 138-152 of FIG. 3. This procedure is essentially the same as the procedure of steps 108-122 of FIG. 2.

Once the wearer has had a chance to try and compare the six available programs (two primary and four secondary), the wearer can choose the two programs that provide the best performance and deactivate the rest. This is accomplished by pressing the push button 28 for a time T3, such as 30 seconds. As shown in FIG. 3, if it is determined that the button 28 is pressed for a time T3 or longer (step 154), the processor 16 sets a flag or stores a value indicating that the currently-loaded program has been designated as chosen (step 156). At this point, the device 10 generates a distinctive sound (step 158) to indicate to the wearer that a program has been chosen. In a preferred embodiment, the device 10 allows the user to choose two of the N number of available programs. However, it will be appreciated that the device 10 could accommodate the choice of more or fewer than two programs.

If it is determined at step 160 that two programs have not yet been chosen, the process waits for the next press of the button 28 (step 152). If it is determined at step 160 that two programs have been chosen, then the other four non-chosen programs are deactivated (step 162 in FIG. 3). At this point, the two best-performing programs as determined by the wearer are available for continued use. (N=2, step 164.) The wearer can now switch between the two available programs using the button pressing procedure of steps 138-152.

In some embodiments of the invention, there is no process for activating and choosing secondary acoustical configuration programs. In such embodiments, the wearer chooses some number of best performing primary or secondary programs (such as N=2) and the thereafter the wearer can switch between those chosen programs. This is represented by the dashed line from the box 132 in FIG. 2 with continuation at step 122. Thus, in these embodiments, processing does not proceed to step 134 in FIG. 3.

In preferred embodiments of the invention, the programming of the hearing assistance device 10 can be reset to default (factory) conditions. In one embodiment, the reset is initiated by pressing the push button 28 for an extended time T5, such as two minutes, which is significantly longer than T3. In another embodiment, the reset is initiated by closing a battery compartment door while simultaneously pressing the button 28. This embodiment includes a switch coupled to the battery compartment door, where the status of the switch is provided to the controller 24. In another embodiment, the reset is initiated by a Dual-Tone Multi-Frequency (DTMF) telephone code received by the telephone coil 30 or microphone 12*a* or 12*b*. In yet another embodiment, the reset is initiated by a coded wireless signal received by the wireless interface 32. In some embodiments, more than one of the above procedures are available for resetting the programming of the device 10.

As described above, in preferred embodiments of the invention, a wearer switches between available programs and chooses programs using the manually operated push button 28 mounted on a housing of the device 10. In alternative embodiments of the invention, the wearer switches between available programs and chooses programs using a wireless remote control device 33, such as an infrared, radio-frequency or acoustic remote control. In these alternative embodiments, a push button is provided on the remote control device 33, and the program selection and choosing process proceeds in the same manner as described above except that the wearer uses the push button on the remote control device 33 rather than a button mounted on the housing of the device 10. In an embodiment including an acoustic remote control, coded acoustic signals, such as a series of clicks in a machine recognizable pattern, may be used to deliver commands to the device 10. Such acoustic control signals may be received by one or both of the microphones 14*a*-14*b* and provided to the processor 16 for processing.

In yet another embodiment incorporating voice recognition technology, the wearer switches between available programs and chooses programs by speaking certain "code words" that are received by one or more of the microphones 12*a*-12*b*, converted to digital control signals and processed by the processor 16 to control operation of the device 10. For example, the spoken phrase "switch program" may be interpreted by the processor 16 in the same manner as a push of the button 28 for a time T2, and spoken phrase "choose program" may be interpreted by the processor 16 in the same manner as a push of the button 28 for a time T3.

Figure 4:
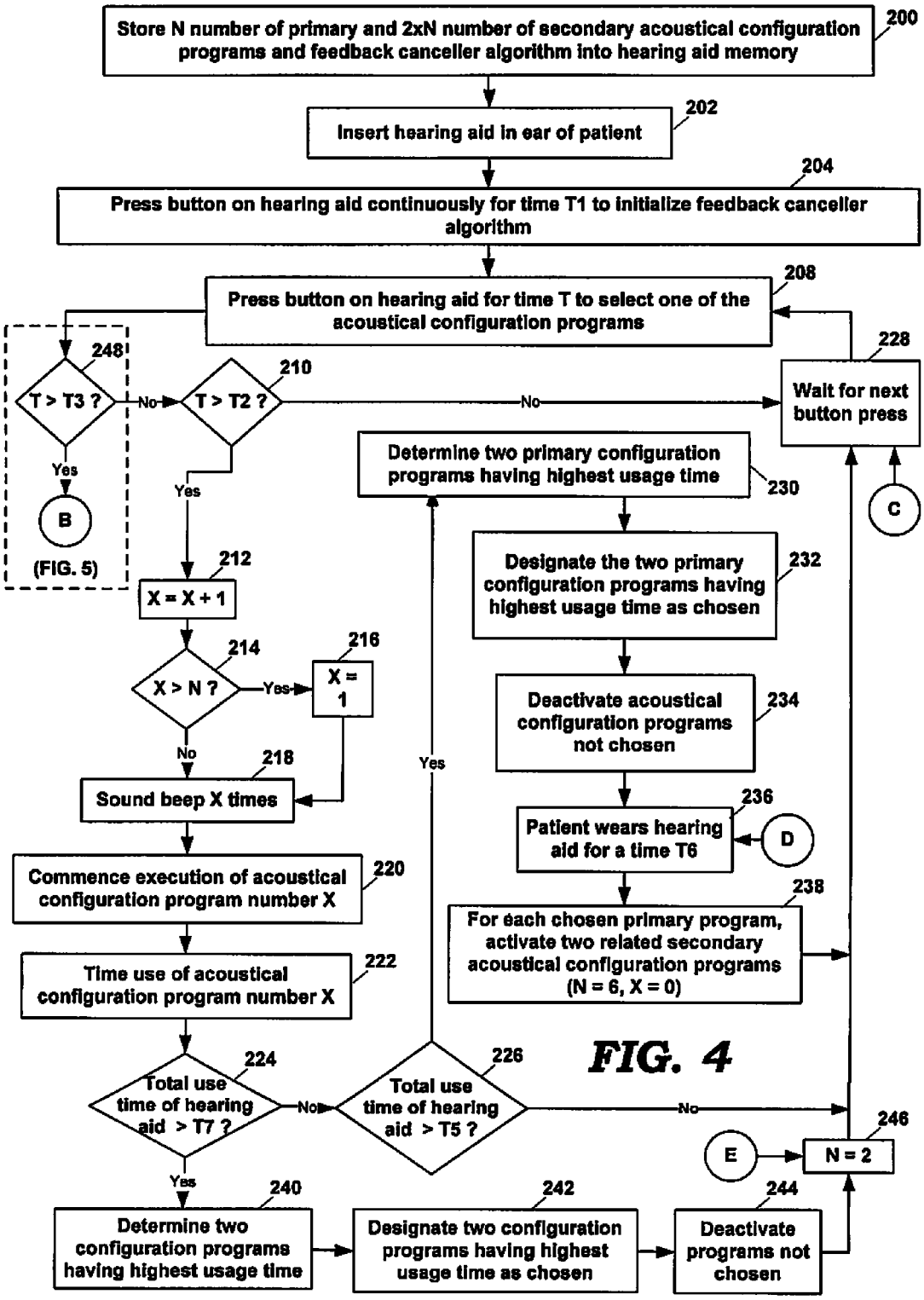
FIGS. 4 and 5 depict a functional flow diagram of the programming of a hearing assistance device according to an embodiment of the invention.
Figure 5:
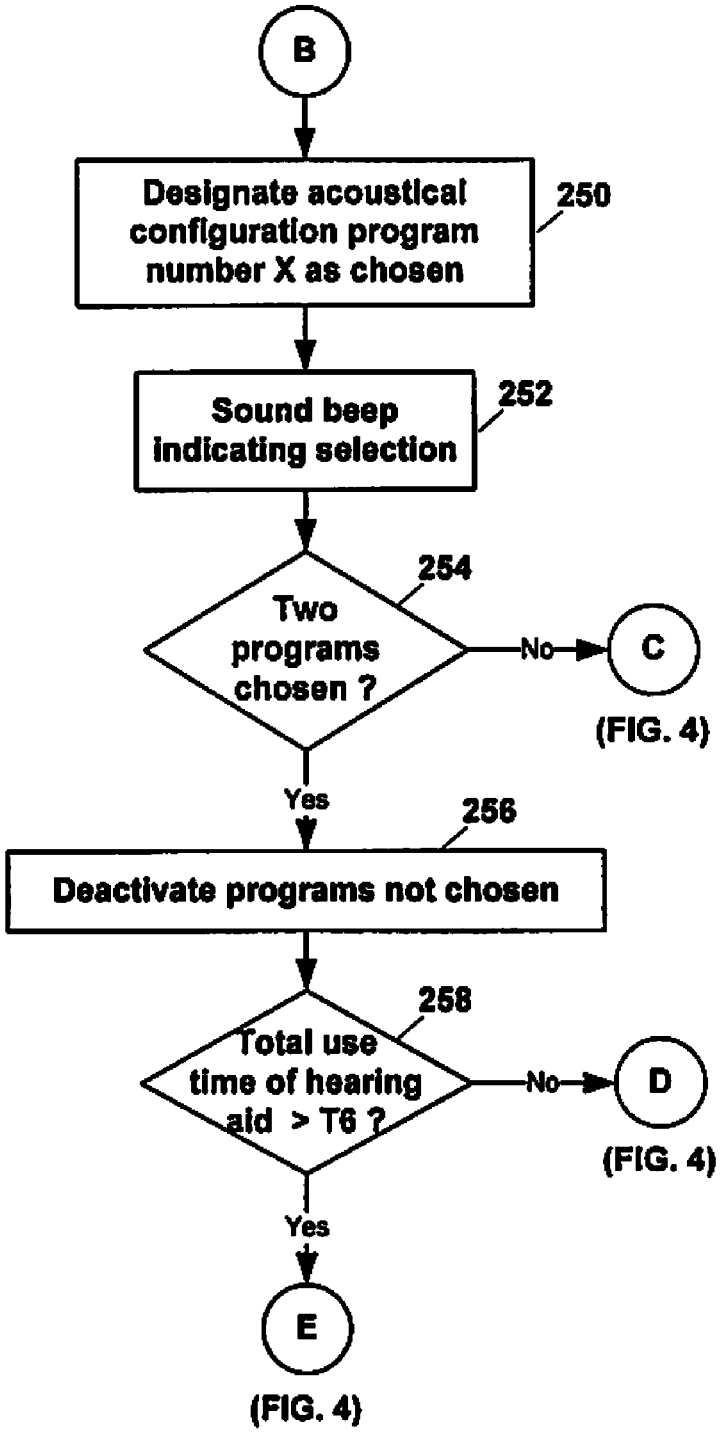

FIGS. 4 and 5 depict a process flow according to another preferred embodiment of the invention wherein the designation of the most effective enhancement programs is based upon a method wherein the wearer of the device evaluates several options for enhancement programs and the device 10 keeps track of how long the wearer uses each program. With this embodiment, the basic assumption is that the program which provides the best performance for the wearer will be the program used most during the evaluation period. As described below, a variation on this embodiment allows the wearer to "override" the time-based designation process and manually choose one or more programs that provide the best performance. This override feature may be provided as an optional operational mode.

As shown in FIG. 4, a first step in the method is to store in memory 26 some number (N) of primary acoustical configuration programs and 2×N number of secondary programs (step 200). This step may be performed at the time of manufacture of the hearing assistance device 10 or at a later time, such as during a reprogramming procedure. In a preferred embodiment of the invention, seven primary programs and fourteen secondary programs are loaded into the device memory 26 (N=7, 2×N=14). However, it will be appreciated that any number of programs may be initially loaded into memory 26, and the invention is not limited to any particular number. In the preferred embodiment of the invention, a feedback canceller algorithm is also stored in the memory 26 of the device 10 at step 200.

At some point after the initial programming of the device (step 200), a wearer inserts the device 10 into the ear canal (in the case of an ITE device) or places the device 10 behind the ear (in the case of a BTE device) with the associated connection to the ear canal (step 202). Once the device 10 is in position, the wearer presses the button 28 for some extended period of time T1, such as 60 seconds, to activate the device 10 and initialize the feedback canceller program (step 204). According to a preferred embodiment of the invention, the feedback canceller program generates and stores acoustical coefficients that will be applicable to all of the primary and secondary acoustical configuration programs stored in the memory 26.

Once the feedback canceller program has performed its initialization procedure, the wearer can cycle through the N number of available primary acoustical configuration programs and try each to determine which provides the best enhancement for the wearer's hearing loss. The wearer does this by pressing the button 28 for at least some period of time T2, such as one second, to switch from one program to the next (step 208). For example, a first program may be executed by the processor 16 when the device 10 is first powered on. When the wearer presses the button 28 for at least one second, a second program is executed by the processor 16 (step 220). In some embodiments, the device 10 generates two beeps (step 218) to indicate to the selection of the second program. When the wearer presses the button 28 again for at least one second, a third program is executed by the processor 16 (step 220) and the device 10 generates three beeps to indicate that the third program is selected. This continues until the wearer has cycled through the N number of programs (such as seven). If the wearer presses the button 28 again for at least one second, the first program is loaded again. This process is represented by steps 208-228 of FIG. 4. To cycle through programs quickly, the wearer may press the button 28 several times consecutively until the desired program is selected. At this point, some number of beeps are generated to indicate which program is selected.

As with the previously described embodiment, if it is determined that the button 28 is pressed for less than one second (step 210), then no new program is loaded for execution and the process waits for the next button press (step 228). This prevents inadvertent switching from one program to the next due to an accidental press of the button 28.

In the embodiment of FIG. 4, a timer circuit is used to time how long each selected primary program is used (step 222). The total time of use of each primary program is logged in memory and is continuously updated as the wearer switches from one program to another. After the wearer has used the device 10 for some extended period of time T5, such as 80 hours (step 226), a calculation is made based on the logged time information to determine which two primary programs have been used most during the T5 period (step 230). The two primary programs having the highest usage time are then designated as chosen (step 232) and the remaining primary programs are deactivated (step 234). The wearer then uses the device 10 with the two chosen primary programs activated for a period of time T6, such as 80 hours (step 236). During this time, the wearer can switch between the two programs as desired.

At the end of the T6 period, the wearer has used the device 10 for a total time of T5+T6, such as 160 hours total. At this point, two secondary acoustical configuration programs are activated for each of the two active primary programs, resulting in a total of six available programs (N=6) (step 238). In a preferred embodiment of the invention, each of the two newly-added secondary programs is a variation on a corresponding one of the two most-used primary programs. This allows the wearer to make a more refined selection so as to "fine tune" the desired acoustical response. At this point in this example, the wearer has six available programs to evaluate and the wearer can again cycle through the available programs using the button pressing procedure depicted in steps 208-228 of FIG. 4.

During the evaluation period of the N number of available primary and related secondary programs, the timer circuit is again used to time how long each program is loaded for use (step 222). The total time of use of each program is logged in memory and is continuously updated as the wearer switches from one program to another. After the wearer has used the device 10 for a total period of time T7 (such as 240 hours, which is significantly greater than the sum of T5+T6) (step 224), a calculation is made based on the logged time information to determine which two of the N number of available programs have been used most since the secondary programs were activated (step 240). The two programs having the highest usage time are then designated as chosen (step 242) and the remaining programs are deactivated (step 244). At this point, the two most-used programs as determined by the time-logging procedure are available for continued use. (N=2, step 246.) The wearer can now switch between the two available programs using the button pressing procedure of steps 208-228.

As mentioned above, a preferred embodiment of the invention allows a wearer to override the time-based selection process and to manually choose one or more programs that provide the best performance for the wearer. This override option is depicted in FIG. 5 and the dashed box portion of FIG. 4. At step 248, if it is determined that the button 28 is pressed for a time T3 or longer, such as 30 seconds, the processor 16 sets a flag or stores a value indicating that the currently-loaded program has been designated as chosen (step 250 in FIG. 5). At this point, the device 10 generates a distinctive sound (step 252) to indicate to the wearer that a program has been chosen. In a preferred embodiment, the device 10 allows the user to choose two of the available acoustical configuration programs. However, it will be appreciated that the device 10 could accommodate the choice of more or fewer than two acoustical configuration programs.

If it is determined at step 254 that two primary programs have not yet been chosen, the process waits for the next press of the button 28 (step 228 in FIG. 4). If it is determined at step 254 that two primary programs have been chosen, then the non-chosen primary programs are deactivated (step 256 in FIG. 5). Thus, at this point, two primary programs are available for use. If the wearer has not yet used the device 10 for at least a total period of time T6 (such as 80 hours) (step 258), then processing continues at step 236 of FIG. 4.

After the wearer has used the device 10 for a time T6 (such as 80 hours) with two primary programs designated as chosen, two secondary programs are activated for each of the two active primary programs, resulting in a total of six available programs (N=6) (step 238). At this point in this example, the wearer again has six available programs from which to choose, and the wearer can again cycle through the six available programs using the button pressing procedure depicted in steps 208-228 of FIG. 4. In this embodiment, the time-logging processing continues as described above unless and until the wearer overrides the procedure by pressing the button 28 for longer than time T3 (step 248). This transfers processing back to step 250 of FIG. 5 where the processor 16 sets a flag or stores a value indicating that the currently-loaded program has been designated as chosen. Once two programs have been chosen (step 254), the non-chosen primary and secondary programs are deactivated (step 256), leaving two programs available for selection.

At this point, the wearer has used the device 10 for at least a total period of time T6 (such as 80 hours) (step 258), so that processing continues at step' 246 of FIG. 4. Two programs are now available for continued use. These two programs were chosen based on the time-logging procedure, or the override procedure, or a combination of both. The wearer can now switch between the two available programs as desired using the button pressing procedure of steps 208-228. If so desired, the programming of the device 10 may be reset to default conditions as described above using the button 28, the wireless interface 32 or the telephone coil 30, as described above.

FIG. 6 depicts one embodiment of a hearing assistance device 300 for masking tinnitus. The device 300, which is also referred to herein as a tinnitus masker, includes a digital processor 316 for processing digital audio signals, such as masking stimuli signals. In one preferred embodiment of the invention, the masking stimuli signals comprise narrow-band audio noise. The audio frequencies of these noise signals generally fall into the human audible frequency range, such as in the 20-20,000 Hz band. In one sense, "processing" these masking stimuli signals means accessing digital audio files (such as .wav or .mp3 files) from a digital memory device 326 and "playing" the files to generate corresponding digital audio signals. In another sense, "processing" the masking stimuli signals means to determine which digital audio files to access from memory 326 based on which frequency ranges of narrow-band noise have been designated as chosen. In yet another sense, "processing" the masking stimuli signals means to generate the masking stimuli signals using an audio masking stimuli generator program executed by the processor 316. In any case, the masking stimuli signals are provided to a D/A converter 318 which converts them to analog audio signals. The analog audio signals at the output of the D/A converter 318 are amplified by an audio amplifier 320 where the level of amplification is controlled by a volume control 334 coupled to a controller 324. The amplified audio signals at the output of the amplifier 320 are provided to a sound generation device 322, which may be an audio speaker or other type of transducer that generates sound waves or mechanical vibrations which the user perceives as sound. The amplifier 320 and sound generation device 322 are referred to collectively herein as an audio output section 319 of the device 300.

In a preferred embodiment of the invention, the masking stimuli signals comprise narrow-band noise signals. However, it will be appreciated that other types of masking stimuli could be generated according to the invention, including frequency-modulated noise or speech babble noise. Thus, the invention is not limited to any particular type of masking stimuli.

As shown in FIG. 6, a manually operated momentary switch 328, also referred to herein as a push button 328, is provided for enabling the user of the device 300 to control various aspects of the operation and programming of the device 300. The push button 328 is preferably very small and located on an outer surface of a housing associated with the device 300. In an embodiment wherein the device 300 is worn on or in the ear of the user, the push button 328 is located on a portion of the housing that is accessible to the user while the user is wearing and using the device 300. For example, the device 300 may be configured as a behind-the-ear (BTE) or in-the-ear (ITE) instrument, with the push button 328 located on an accessible surface of the instruments. In an alternative embodiment of the invention, the wearer switches between available masking stimuli programs and chooses programs using a wireless remote control device 333, such as an infrared, radio-frequency or acoustic remote control.

In one alternative embodiment, the tinnitus masking device 300 is disposed in a housing suitable for tabletop use, such as on a bedside table. In this "tabletop" embodiment, the push button 328 and volume control 334 may be located on any surface of the housing that is easily accessible to the user. The sound generation device 322 of this embodiment is preferably a standard audio speaker such as may typically be used in a tabletop clock radio device. It could also have an extension pillow speaker.

The push button 328 is electrically connected to a controller 324 which generates digital control signals based on the state (open or closed) of the switch of the push button 328. In a preferred embodiment of the invention, the digital control signals are generated by the controller 324 based on how long the push button 328 is pressed. In this regard, a timer is included in the controller 324 for generating a timing signal to time the duration of the pressing of the button 328. Further aspects of the operation of the controller 324 and the push button 328 are described in more detail below.

Nonvolatile memory 326, such as read-only memory (ROM), programmable ROM (PROM), electrically erasable PROM (EEPROM), or flash memory, is provided for storing programming instructions, digital audio sound files and other operational parameters for the device 300. Preferably, the memory 326 is accessible by one or both of the processor 316 and the controller 324.

Figure 7:
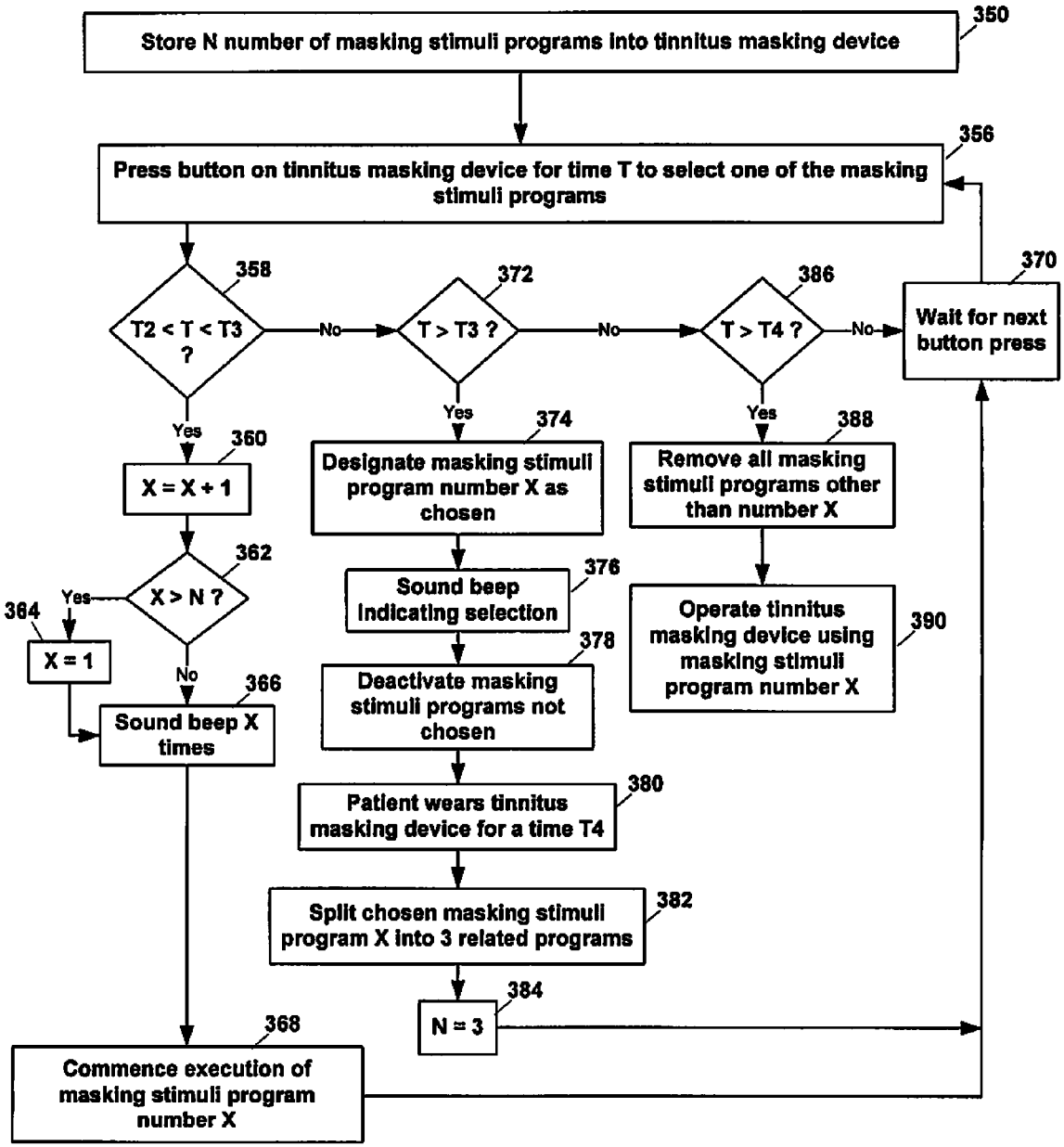
FIG. 7 depicts a functional flow diagram of the programming of a tinnitus masking device according to an embodiment of the invention.

FIG. 7 depicts a process flow according to one preferred embodiment of the invention wherein the selection of most effective masking stimulus for tinnitus masking is based upon a "trial and error" interactive and iterative method where the user of the device 300 evaluates several options for noise frequency and chooses a frequency range that provides the best masking experience for the individual user. As shown in FIG. 7, a first step in the method is to store in memory various parameters for generating some number (N) of "programs" for generating narrow-band noise using the device 300 (step 350). When referring to the operation of the tinnitus masking device 300, a "program" may refer to various stored commands, values, settings or parameters that are accessed by masking stimuli generation software or firmware to cause the software or firmware to generate masking stimuli within a particular frequency band or masking having particular spectral aspects. In another sense, "program" may refer to a specific digital audio file (Away, .mp3, etc.) containing masking stimuli, such as audio noise in a particular frequency band or having particular spectral aspects. The step 350 may be performed at the time of manufacture of the device 300 or at a later time, such as during a reprogramming procedure.

A user of the tinnitus masking device 300 can cycle through N number of available masking stimuli programs and evaluate each to determine which provides the best masking for the user's tinnitus condition. The user does this by pressing the button 328 for at least some period of time T2, such as one second, to switch from one masking program to the next (step 356). For example, a first masking program may be activated when the device 300 is first powered on. When the wearer presses the button 328 for at least one second, a second masking program is loaded from memory 326 to the processor 316 and the device 300 generates two beeps (step 366) to indicate to the user that the second masking program is loaded. When the wearer presses the button 328 again for at least one second, a third masking program is loaded from memory 326 to the processor 316 and the device 300 generates three beeps to indicate that the third masking program is loaded. This continues until the user has cycled through the N number of masking programs. If the wearer presses the button 328 again for at least five seconds, the first program is loaded for execution again. This process is represented by steps 356-370 of FIG. 7.

If it is determined that the button 328 is pressed for less than one second (step 358), then no new masking program is loaded and the process waits for the next button press (step 370). This prevents inadvertent switching from one masking program to the next due to an accidental press of the button 328.

Once the user has had a chance to evaluate all of the available masking stimuli programs, the user may find that some smaller number of the programs, such as one or two, seem to be used the most because they provide the best masking performance for the user in various situations. For example, one of the masking stimuli programs may provide the best masking when the user is trying to sleep. Another of the masking stimuli programs may provide the best masking when the user is trying to concentrate while reading. A preferred embodiment of the invention allows the user to eliminate masking stimuli programs that are not used or rarely used, and to evaluate some additional masking stimuli programs that are variations on the best performing programs. This is accomplished by pressing the push button 328 for a time T3, such as 30 seconds, which is longer than the time T2, as described below.

As shown in FIG. 7, if it is determined that the button 328 is pressed for a time T3 or longer (step 372), the processor 316 sets a flag or stores a value indicating that the currently-loaded masking stimulus program has been designated as chosen (step 374). At this point, the device 300 generates a distinctive sound (step 376) to indicate to the user that a preferred masking stimulus program has been chosen. The masking stimuli programs not chosen are then deactivated (step 378). Deactivation in this sense means that the non-chosen programs are no longer available for selection using the procedure of repeated pressing of the button 328.

After the user has used the device 300 for some extended period of time T4 (step 380), such as 40 hours, the frequency band of the chosen program is "split" to provide two additional masking stimuli programs (step 382). In the preferred embodiment of the invention, the two new programs provide masking stimuli in two frequency bands that are sub-bands of the frequency band of the chosen masking stimuli program. For example, in a case where the chosen program provides masking stimuli in the 1000-3000 KHz band, one of the newly activated programs may cover 1000-2000 KHz and the other newly activated program may cover 2000-3000 KHz. At this point, three masking stimuli programs are available for continued use and evaluation (N=3, step 384).

The user can now switch between the three available masking stimuli programs using the button pressing procedure of steps 356-370 to decide which of the three provides the best masking performance. As described above, the user designates one of the three masking stimulus programs as chosen by pressing the button 328 for at least the time T3 (step 372). The process steps 374-384 are then performed based on the newly-chosen masking stimulus program. This selection procedure may be repeated any number of times to allow the user to "tune in" on the most effective masking stimulus program.

Once the user is satisfied with a particular masking stimulus program, the user presses the button 328 for a time T4, such as 30 seconds (step 386), at which point all non-chosen masking stimuli programs are removed or deactivated (step 388). From this point forward, the tinnitus masking device 300 operates indefinitely using the one selected masking stimulus program.

In an alternative embodiment of the invention, instead of pressing the button 328 to choose a masking stimuli program, the wearer presses the button 328 for at least time T3 to deactivate a non-chosen program. Thus, it will be appreciated that the invention is not limited to the manner in which masking stimuli programs are designated as chosen or not chosen.

As with the hearing assistance device 10, the tinnitus masking device 300 may be reset to default (factory) conditions by the user. In one embodiment, the reset is initiated by pressing the push button 328 for an extended time T5 which is significantly longer than T4, such as two minutes. In another embodiment, the reset is initiated by closing the battery compartment while simultaneously pressing the button 328. In yet another embodiment, the reset is initiated using the wireless remote control device 333.

In one alternative embodiment, the invention provides a hearing assistance device which is combination hearing aid and tinnitus masker. This embodiment comprises components as depicted in FIG. 1, which include the push button 28 for controlling the selection of hearing aid acoustical configuration programs for the hearing aid function (as described in FIGS. 2-5) and a second push button 328 for controlling the selection of masking stimuli programs for the tinnitus masking function (as described in FIG. 7). Alternatively, a single push button may be used for first programming the hearing aid functions and then programming the tinnitus masking functions. Those skilled in the art will appreciate that the processor 16 and controller 24 may be programmed to implement the hearing aid functions and the tinnitus masking functions simultaneously.

In some preferred embodiments of the invention, instead of or in addition to using a clock signal to determine elapsed operational time of the hearing assistance device 10 (or tinnitus masking device 300), elapsed time is determined based on counting the number of times various events occur during the lifetime of the device. For example, since the battery of a hearing assistance device must be replaced periodically, one can count the number of times the battery is replaced to approximate the elapsed operational time of the device. Also, since hearing assistance devices are typically removed and powered down each evening, one can count the number times a device has been cycled on and off, either by opening the battery compartment or by operating an on/off switch, to approximate the elapsed operational time.

Various batteries used in hearing assistance devices have operational lifetimes ranging from about 3 days to about 30 days, where the exact lifetime depends on the capacity of the particular battery and the power demand of the hearing assistance device. Accordingly, if the expected lifetime of a particular battery in a particular hearing assistance device is 10 days, and the battery has been replaced three times, then one can estimate that the hearing assistance device has been in use for about 30 days. In a preferred embodiment of the invention, the expected lifetime of the battery is a value that is stored in the memory 26 of the hearing assistance device. This value may be updated depending on the particular model of battery in use and the expected power demand of the particular hearing assistance device.

Figure 8:
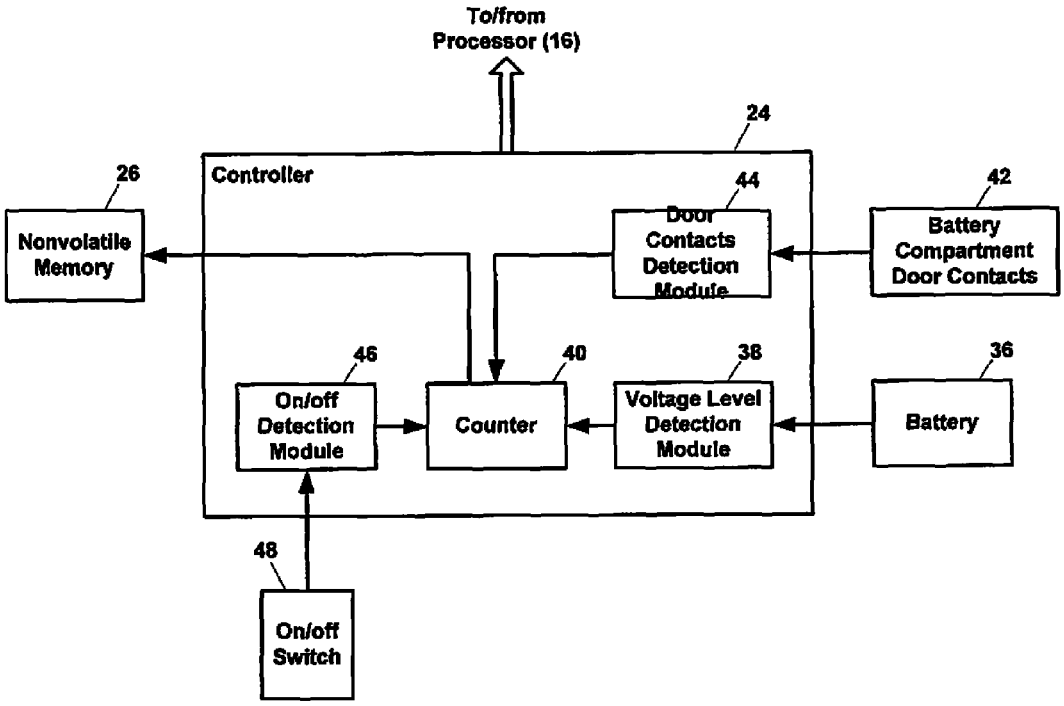
FIG. 8 depicts a functional block diagram of components of a hearing assistance device according to an embodiment of the invention.

As shown in FIG. 8, the opening and closing of battery compartment door contacts 42 provide an indication that the battery compartment door has been opened and closed. For example, a set of electrical contacts are provided which are closed when the battery compartment door is closed and open when the compartment door is opened. A door contact detection module 44 monitors the battery compartment contacts 42 and generates an "on" or "high" logic signal when the contacts 42 are open and an "off" or "low" logic signal when the contacts 42 are closed. This logic signal is provided to a counter 40 which is incremented each time the signal goes high. A counter value of n indicates that the battery compartment door has been opened n times, indicating either n number of battery replacements or n number of times that the device has been powered down by opening the battery compartment. The counter value is preferably stored in the non-volatile memory device 26. For a typical device (having no separate power on/off switch) that is powered down at the end of each day by opening the battery compartment door, a value n may indicate a total use time of n days. If a device does have a separate on/off switch, and the battery is typically removed only when it is being replaced, a value n may indicate a total use time of n×x days, where x is the expected lifetime of the battery in days.

As also shown in FIG. 8, a voltage level detection module 38 may be provided which monitors the voltage of the battery 36. The voltage level detection module 38 may generate an "on" or "high" logic signal whenever the battery voltage increases by some number of volts, indicating that an old battery has been replaced with a fresh one. This logic signal is provided to the counter 40 which is incremented each time the signal goes high. Similar to the battery replacement example above, a counter value of n indicates that the battery has been replaced n times, which indicates a total use time of n×x days.

With continued reference to FIG. 8, a momentary on/off switch 48 may be provided to turn the hearing assistance device 10 on and off. For example, the switch 48 may be pressed once to turn the device on and once again to turn the device off. An on/off switch detection module 46 monitors the on/off switch 48 and generates an "on" or "high" logic signal each time the switch 48 is operated. This logic signal is provided to the counter 40 which increments each time the signal goes high. A counter value of n indicates that the device 10 (or the device 300) has been cycled on and off n/2 times. For example, if a device is typically turned on and off once per day, a counter value of n indicates the device has been in use for n/2 days.

Accordingly, in each operation depicted in FIGS. 2-5 and 7 wherein a value for the total elapsed operational time of the device is needed, this time value may be determined based on the counter value generated by the counter 40. For example, the counter value may be used to determine the time value in step 134 of FIG. 3, the time value in step 222 of FIG. 4, the time value in step 258 of FIG. 5, and the time value in step 380 of FIG. 7.

It will be appreciated that a combination of two or more counter values may be used to calculate an elapsed operational time value. For example, one counter value may keep track of the number of times the battery compartment door contacts have opened/closed and another counter value may keep track of the number of times the battery voltage goes from a low value to a high value. In this example, if one counter value indicates that the battery compartment door has been opened/closed once and the other counter value indicates that the battery voltage has not changed significantly, this may indicate that the battery compartment door was opened to power down the device, but the battery was not replaced.

In another example, the on/off switch counter value may indicate that the device has been in operation for 30 days, and the battery voltage level counter value may indicate that the device has been in operation for 40 days. In various embodiments, an average of these two time values, the greater of these two time values, or the lesser of these two time values may be selected as the elapsed operational time value.

FIG. 8 depicts the detection modules 38, 44 and 46 and the counter 40 as components of the controller 24. It will be appreciated that in other embodiments, any or all of these components may be in provided in circuitry which is separate from the controller 24.

Figure 9A:
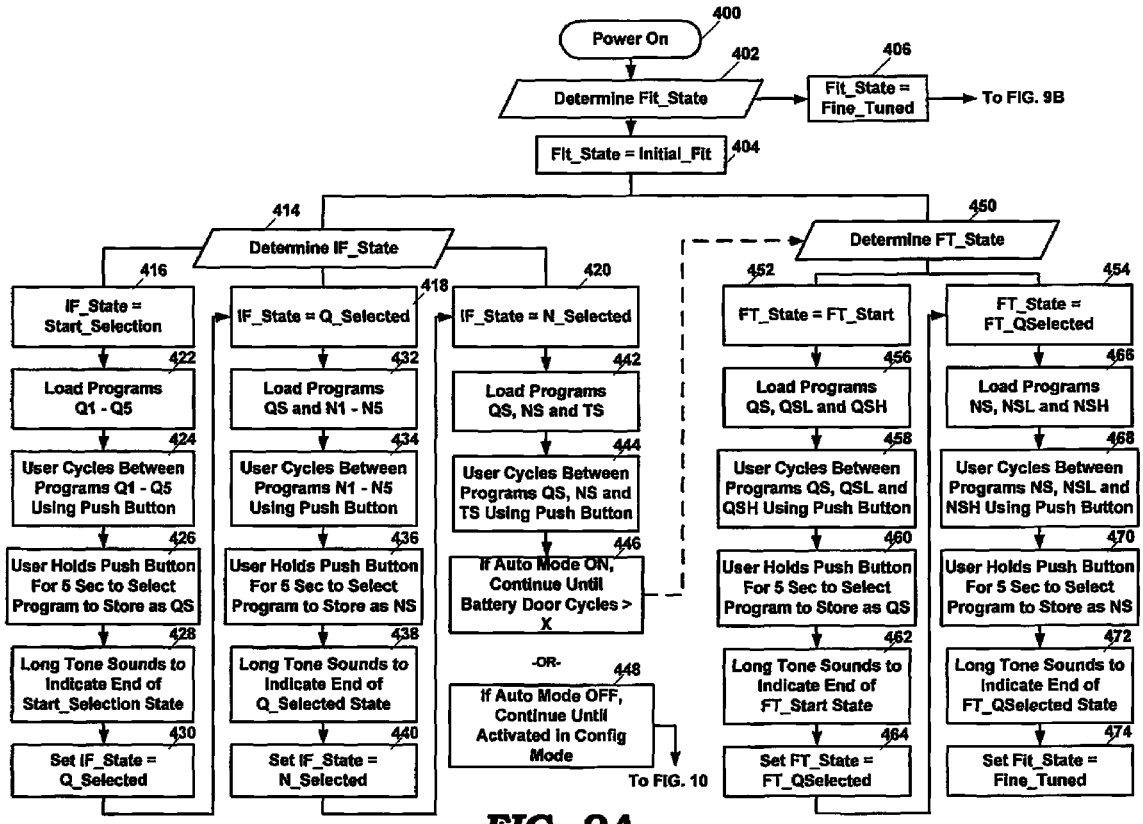
FIGS. 9A and 9B depict state diagrams for program selection modes of a hearing assistance device according to an embodiment of the invention.
Figure 9B:
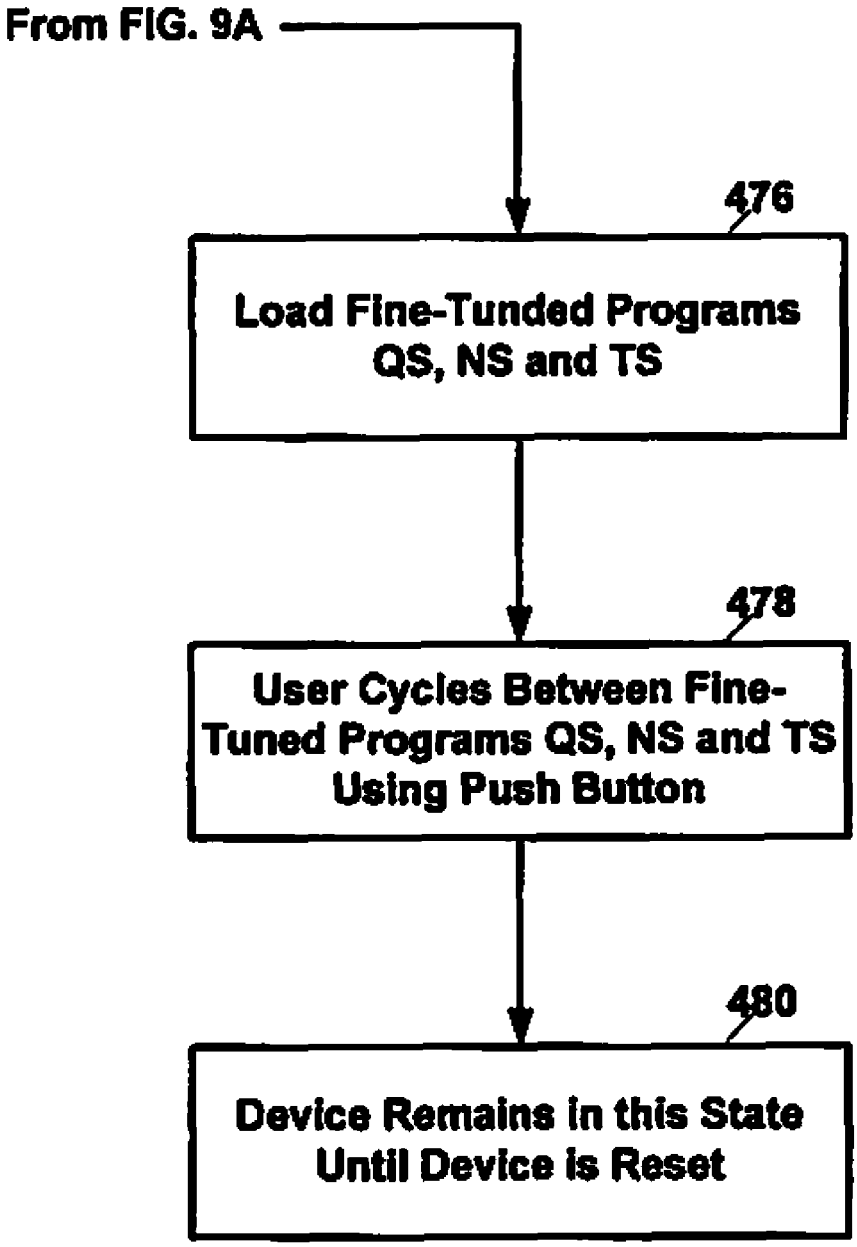

FIGS. 9A and 9B depict state diagrams for program selection modes of a hearing assistance device (such as the device 300 in FIG. 6) according to an embodiment of the invention. As shown in FIG. 9A, when the device is powered on (step 400), the processor 316 determines the current status of Fit_State (step 402), which may be either Initial_Fit or Fine_Tuned. (When the device 10 is powered-up for the first time after delivery to the user, Fit_State=Initial_Fit.) If Fit_State=Fine_Tuned at power up (step 406), the processor 316 executes the process depicted in FIG. 9B and described hereinafter.

If Fit_State=Initial_Fit at power up (step 404), the processor determines the current status of IF_State (step 414), which may be either Start_Selection, Q_Selected or N_Selected. If IF_State=Start_Selection (step 416), the processor loads some number of quiet acoustical condition programs (step 422) from nonvolatile memory 326. In a preferred embodiment, five quiet acoustical condition programs Q1-Q5 are available. These programs are also referred to herein as initial-tuning programs or primary acoustical programs. While wearing and using the device, the user can switch from one of the programs Q1-Q5 to the next by pressing the push button 28 once for a relatively short duration (step 424), such as less than five seconds. The push button 28 is also referred to herein as the push button control 28. When switching from one Q-program to the next, the audio output section 319 emits an auditory indicator of the active program, such as some number of pure-tone beeps indicating the number of the program. At any time during use of the Q-programs, the user can select one of the programs Q1-Q5 to be designated as a selected or preferred program by pressing and holding the button 28 for five seconds or longer (step 426). The selected program is referred to herein as quiet acoustical condition program QS. At this point a long tone sounds to indicate to the user that the QS program is selected and the Start_Selection state is completed (step 428). Once QS is selected, the non-selected Q-programs are deactivated. In preferred embodiments, the non-selected Q-programs are not erased, but are available for reactivation by resetting the device using the Configuration Mode described below. At this point, IF_State is set to Q_Selected (step 430).

With continued reference to FIG. 9A, if IF_State=Q_Selected (step 418), the processor loads the selected QS program and some number of noisy acoustical condition programs (step 432) from nonvolatile memory 326. In a preferred embodiment, five noisy acoustical condition programs N1-N5 are available. These programs are also referred to herein as initial-tuning programs or primary acoustical programs. While wearing and using the device 300, the user can switch from one of the programs N1-N5 to the next by pressing the push button 28 once for a relatively short duration (step 434), such as less than five seconds. When QS is activated, a pure-tone beep is emitted through the audio output section 319. When any one of the noisy environment programs N1-N5 is activated, a noise pulse train is emitted through the audio output section 319, with the number of pulses corresponding to the choice of N1-N5 (e.g. one pulse for N1, two pulses for N2, etc.). Any one of the programs N1-N5 may be designated as a selected or preferred program by pressing and holding the button 28 for five seconds or longer (step 436). The selected program is referred to herein as noisy environment program NS. Once NS is selected, the non-selected noisy environment programs are deactivated (but not erased) and are available for reactivation by resetting the device using the Configuration Mode described below. At this point a long tone sounds to indicate to the user that the NS program is selected and the Q_Selected state is completed (step 438). IF_State is then set to N_Selected (step 440).

If IF_State=N_Selected (step 420), the processor loads from nonvolatile memory 326 the selected quiet environment program QS, the selected noisy environment program NS and one of the telecoil programs (T1-T5) (step 442). The selected telecoil program (designated as TS for purposes of this description) is automatically selected based on the selection of the program QS, with the selection of program T1-T5 corresponding to the selection of program of Q1-Q5. For example, if QS=Q5, then TS=T5. While wearing and using the device, the user can now switch between the programs QS, NS and TS by pressing the push button 28 once for a relatively short duration (step 444), such as less than five seconds. If program QS is selected, a pure-tone beep is emitted from the audio output section 319. If program NS is selected, a noise pulse is emitted. If program TS is selected, a dial-tone pulse or a ring sound is emitted.

If the device is operating with Auto Mode off, which is the preferred factory-default setting, the device continues operating in the initial-tuning mode until the device is activated in the Configuration Mode, which is described in more detail hereinafter (step 448). Using the Configuration Mode options, Auto Mode may be set to on or off by an audiologist/dispenser. If the device has been set by an audiologist/dispenser to operate with Auto Mode on, the device continues operating in an initial-tuning mode (with the selected programs QS, NS and TS available) until the battery compartment door has been opened and closed more than X number of times (step 446). Auto Mode is also referred to herein as Fine Tuning mode.

Referring back to steps 400-404 of FIG. 9A, if at power-up, Fit_State=Initial_Fit and Auto Mode is on and the initial selections of QS, NS and TS have been made and the battery compartment door has been opened and closed more than X number of times, the processor determines the current status of FT_State (step 450), which may be either FT_Start or FT_QSelected. ("FT State" represents the Fine Tune state of the device.) If FT_State=FT_Start (step 452), the processor loads from nonvolatile memory 326 a pair of additional quiet acoustical condition programs QSL and QSH that are slight variations on the program QS (step 456). This provides the user five available programs (QS, QSL, QSH, NS and TS) to can try out indefinitely. In a preferred embodiment, the programs QSL and QSH are secondary acoustical characteristic configuration programs, such as described above. These programs are also referred to herein as fine-tuning programs. While wearing and using the device 300, the user can switch between the programs QS, QSL, QSH, NS and TS by pressing the push button 28 once for a relatively short duration (step 458), such as less than five seconds. Once the user has developed a preference for one of the quiet environment programs (QS, QSL or QSH), the user can designate the preferred quiet environment program as a selected program by pressing and holding the button 28 for five seconds or longer (step 460). The program so selected is then designated as program QS and the two non-selected Q-programs are deactivated. The TS program is automatically updated and activated to match the selected QS program. At this point a long tone sounds to indicate to the user that the FT_Start state is completed (step 462), and FT_State is set to FT_QS elected (step 464).

If FT_State=FT_QSelected (step 454), the processor loads from nonvolatile memory 326 a pair of noisy environment acoustical condition programs NSL and NSH that are slight variations on the program NS (step 466). This provides the user five available programs (QS, NS, NSL, NSH and TS) to try out indefinitely. In a preferred embodiment, the programs NSL and NSH are secondary acoustical characteristic configuration programs, such as described above. These programs are also referred to herein as fine-tuning programs. While wearing and using the device 300, the user can switch between the programs QS, NS, NSL, NSH and TS by pressing the push button 28 once for a relatively short duration (step 468), such as less than five seconds. Once the user has developed a preference for one of the noisy environment programs (NS, NSL or NSH), the user can designate the preferred noisy environment program as a selected program by pressing and holding the button 28 for five seconds or longer (step 470). The program so selected is then designated as program NS and the two non-selected N-programs are deactivated. At this point a long tone sounds to indicate to the user that the FT_QSelected state is completed (step 472), and FT_State is set to Fine_Tuned (step 474).

Referring back to steps 400-406 of FIG. 9A, if at power-up, Fit_State=Fine_Tuned, the processor loads from nonvolatile memory 326 the selected quiet environment program QS, the selected noisy environment program NS and the selected telecoil program TS (step 476 in FIG. 9B). While wearing and using the device, the user can switch between the programs QS, NS and TS by pressing the push button 28 once for a relatively short duration (step 478), such as less than five seconds. In a preferred embodiment, the device continues operating in this state (Fit_State=Fine_Tuned) until the device is reset (step 480). Resetting of the device may be accomplished in the Configuration Mode as described below.

Figure 10:
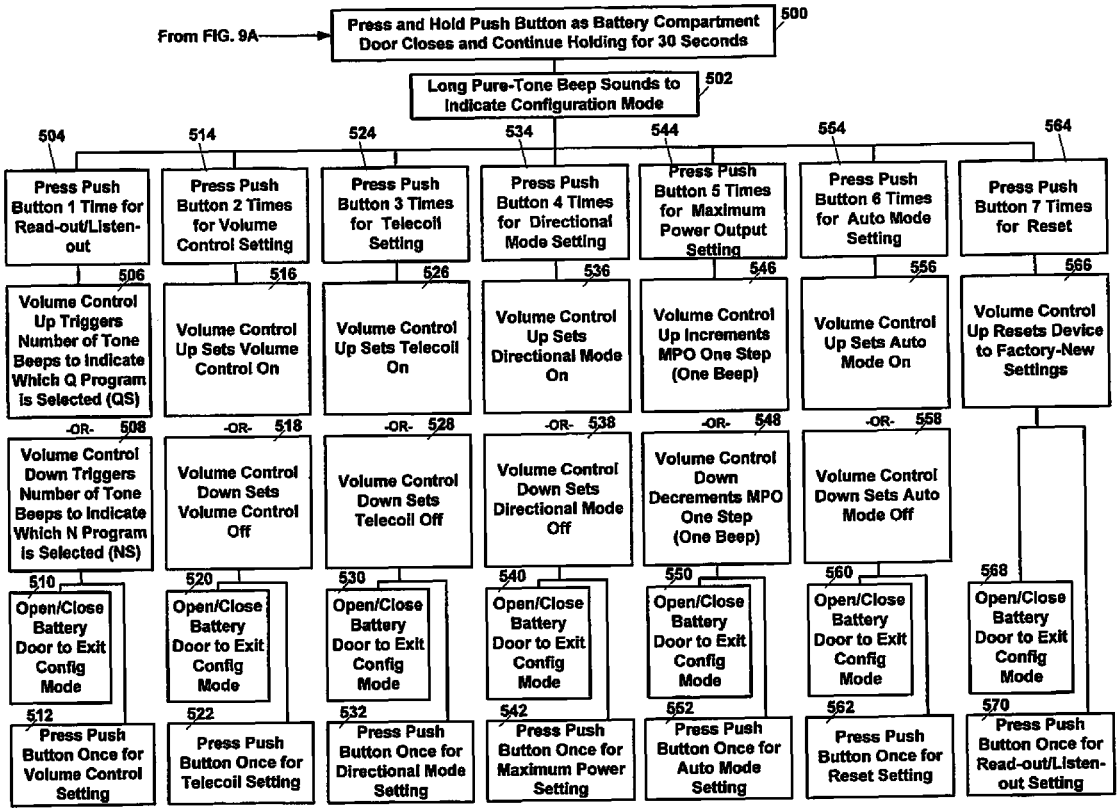
FIG. 10 depicts a state diagram for a configuration mode of a hearing assistance device according to an embodiment of the invention.

FIG. 10 depicts a state diagram for the Configuration Mode of a hearing assistance device (such as the device 10 depicted in FIG. 1) according to a preferred embodiment of the invention. In the Configuration Mode, an audiologist or dispenser can configure several options which determine how the device operates. These options are described in more detail below. Although anyone, including the user of the hearing assistance device, could perform the operations described herein to change the configuration of the device, it is anticipated that in most cases an audiologist or dispenser of the device will perform these operations for the user.

The device enters the Configuration Mode when the audiologist/dispenser presses the push button 28 while closing the battery compartment door and continues to press the push button 28 for at least 30 seconds (step 500 in FIG. 10). A long pure-tone beep sounds to indicate that the device has entered the Configuration Mode (step 502). Once in the Configuration Mode, the device option to be configured may be selected based on how many consecutive times the push button 28 is pressed. Each press of the push button 28 will step to a next configuration option in a sequence of options, and will eventually wrap around and start through the sequence again when the last configuration option is passed.

If the audiologist/dispenser presses the push button 28 only once after entering the configuration mode, the "Read-out/Listen-out" option is selected (step 504). Using this option, the audiologist/dispenser can determine which of the fifteen quiet environment condition programs (Q1-Q5 and two fine-tuning programs QSL-QSH for each program Q1-Q5) is the current selected program QS and which of the fifteen noisy environment condition programs (N1-N5 and two fine-tuning programs NSL-NSH for each program N1-N5) is the current selected program NS. If the volume-up control 334*a* is pressed, some number of tone beeps are sounded to indicate which of the fifteen quiet-environment programs is the current selected program QS (step 506). For example, if the program Q3 is the selected program QS, then three tone beeps may be sounded when the volume-up control 334*a* is pressed. Likewise, if the volume-down control 334*b* is pressed, some number of tone beeps are sounded to indicate which of the fifteen noisy-environment programs is the current selected program NS (step 508). If the battery compartment door is opened and closed, the device exits the Configuration Mode (step 510). If the push button 28 is pressed once while the "Read-out/Listen-out" option is selected, then the "Volume Control Setting" option is selected (step 512).

If the push button 28 is pressed only twice after entering the Configuration Mode, the "Volume Control Setting" option is selected (step 514). Using this option, the audiologist/dispenser can control whether the volume control 334 will be activated or deactivated when the device is next operated in the standard operational mode. If the volume-up control 334*a* is pressed, the volume control 334 will be activated (step 516). Likewise, if the volume-down control 334*b* is pressed, the volume control 334 will be deactivated (step 518). If the battery compartment door is opened and closed, the device exits the Configuration Mode (step 520). If the push button 28 is pressed once while the "Volume Control Setting" option is selected, then the "Telecoil Setting" option is selected (step 522).

If the push button 28 is pressed only three times after entering the Configuration Mode, the "Telecoil Setting" option is selected (step 524). Using this option, the audiologist/dispenser can control whether the telephone coil 30 (FIG. 1) will be activated or deactivated when the device 300 is next operated in the standard operational mode. If the volume-up control 334*a* is pressed, the telephone coil 30 will be activated (step 526). Likewise, if the volume-down control 334*b* is pressed, the telephone coil 30 will be deactivated (step 528). If the battery compartment door is opened and closed, the device exits the Configuration Mode (step 530). If the push button 28 is pressed once while the "Telecoil Setting" option is selected, then the "Directional Mode Setting" option is selected (step 532).

If the push button 28 is pressed only four times after entering the Configuration Mode, the "Directional Mode Setting" option is selected (step 534). Using this option, the audiologist/dispenser can control whether the Directional Mode is activated in which the device uses two microphones, or deactivated so that the device uses a single microphone. If the volume-up control 334*a* is pressed, the directional mode will be activated (step 536). Likewise, if the volume-down control 334*b* is pressed, the directional mode will be deactivated (step 538). If the battery compartment door is opened and closed, the device exits the Configuration Mode (step 540). If the push button 28 is pressed once while the "Directional Mode Setting" option is selected, then the "Maximum Power Output Setting" option is selected (step 542).

If the push button 28 is pressed only five times after entering the configuration mode, the "Maximum Power Output Setting" option is selected (step 544). Using this option, the audiologist/dispenser can control the maximum output power level of the audio section 319 (FIG. 6). Each time the volume-up control 334*a* is pressed, the maximum power output level is incremented one step and one beep sounds (step 546). Each time the volume-down control 334*b* is pressed, the maximum power output level is decremented one step and one beep sounds (step 548). If the battery compartment door is opened and closed, the device exits the Configuration Mode (step 550). If the push button 28 is pressed once while the "Maximum Power Output Setting" option is selected, then the "Auto Mode Setting" option is selected (step 552).

If the push button 28 is pressed only six times after entering the configuration mode, the "Auto Mode Setting" option is selected (step 554). Using this option, the audiologist/dispenser can control the event that triggers the transition from the initial-tuning mode to the fine-tuning mode. As described above in reference to FIG. 9A, if Auto Mode is activated, the device automatically transitions from the initial-tuning mode to the fine-tuning mode after the battery compartment door has been opened and closed some X number of times. If Auto Mode is not activated (which is the preferred default condition), this automatic transition does not occur. When the Auto Mode Setting option is selected, the audiologist/dispenser can activate the Auto Mode by pressing the volume-up control 334*a* (step 556). If desired, once the Auto Mode is activated, the audiologist/dispenser can cause the device to transition from the initial-tuning mode to the fine-tuning mode by opening/closing the battery compartment door X number of times. If Auto Mode is activated and the volume-down control 334*b* is pressed, Auto Mode will be deactivated (step 558). If the battery compartment door is opened and closed, the device exits the Configuration Mode (step 560). If the push button 28 is pressed once while the "Auto Mode Setting" option is selected, then the "Reset" option is selected (step 562).

If the push button 28 is pressed only seven times after entering the Configuration Mode, the "Reset" option is selected (step 564). Using this option, the audiologist/dispenser can reset the device to its factory settings by pressing the volume-up control 334*a* (step 566). If the battery compartment door is opened and closed, the device exits the Configuration Mode (step 568). If the push button 28 is pressed once while the "Reset" option is selected, then the device cycles back to the "Read-out/Listen-out Setting" option (step 570).

In some embodiments, a Clinician-Assisted Fitting Mode is also provided as an option accessible through the Configuration Mode. In these embodiments, the Clinician-Assisted Fitting Mode may be activated to allow a clinician to assist a patient in fine-tuning the hearing assistance device. In this mode, the clinician may use the push button 28 or 328 to select an optimum set of quiet environment, noisy environment and telecoil programs for the patient. Other configuration settings may also be available in the Configuration Mode, such as gain increase/decrease, noise reduction on/off, and feedback canceller fast/slow, to name a few examples.

In some embodiments of the invention, the hearing assistance device 10 may be used to record audio memos. A memo recording function may be activated using one or more push buttons, such as the button 28, and the volume control 34. With reference to FIG. 1, the microphone 12*a* receives the vocal sounds of the user, the A/D 14*a* converts the microphone signal to a digital audio signal, the processor 16 converts the digital audio signal to an appropriate digital audio file format for storage, such as a .WAV file, and the memory 26 is used for storage of the digital audio file. At a later time, the one or more push buttons, such as the button 28, and the volume control 34 may be used to access the stored digital audio file and play it back through the audio output section 19. Such a function would be quite useful for quickly and easily recording information for later recall when other recording means are not readily available. For example, the memo function could be used to record a list of items to pick up at the grocery store, or a telephone number of a friend or acquaintance.

Figure 12:
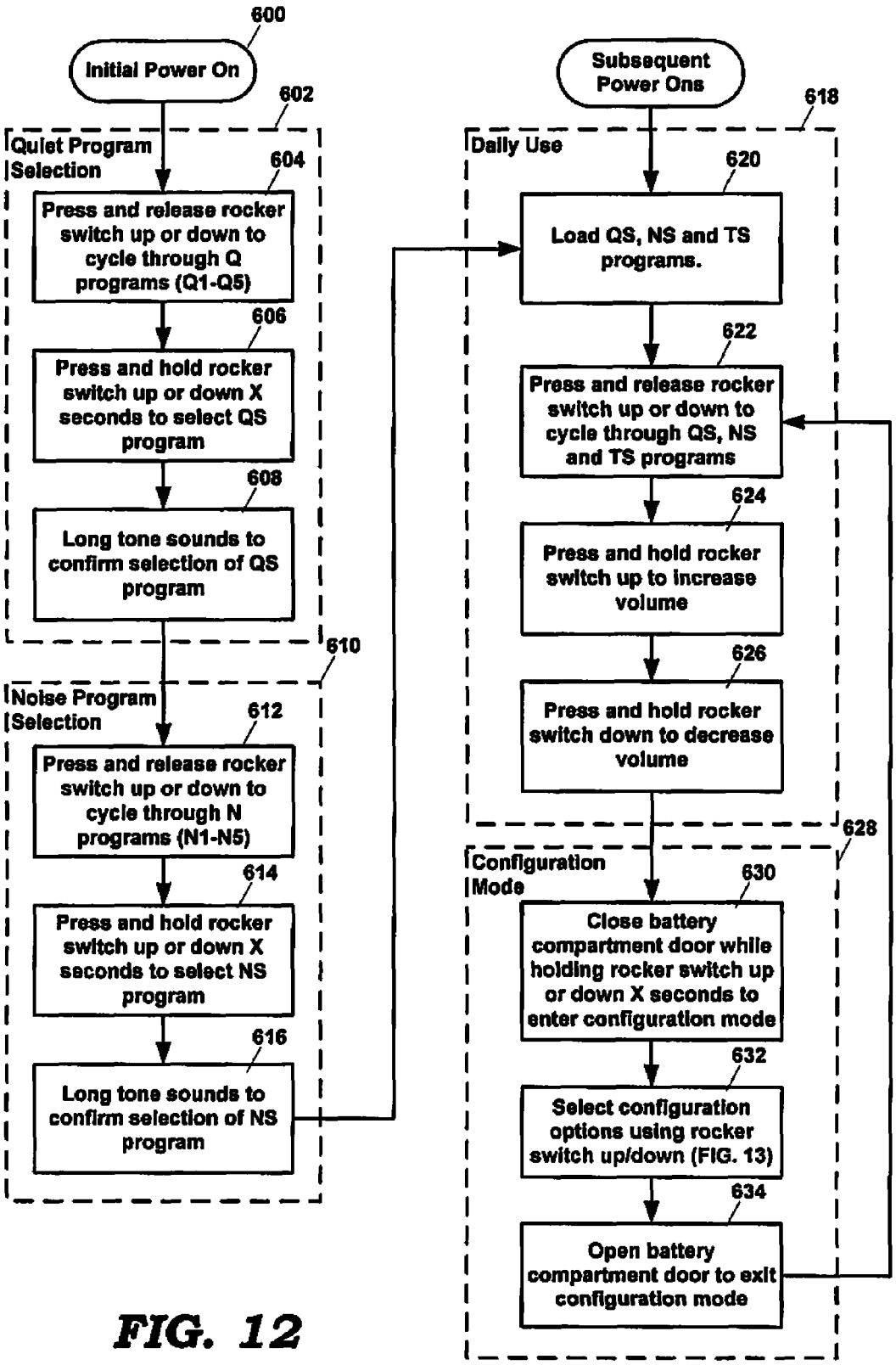
FIG. 12 depicts a functional flow diagram of the programming of a hearing assistance device according to an embodiment of the invention.

In a preferred embodiment of the invention, the rocker switch 34 depicted in FIG. 11 is used to select preferred audio processing algorithms during a setup procedure, to switch between quiet, noise and telecoil programs during daily use, to control audio volume during daily use, and to change configuration settings. FIG. 12 depicts a functional flow diagram which describes how the up and down controls 34*a*-34*b* of the rocker switch 34 may be so used in one embodiment.

As shown in FIG. 12, when the device 10 is initially powered-on (step 600), such as by inserting a battery and closing the battery compartment door, the processor 16 (FIG. 11) enters a quiet program selection mode 602. In preferred embodiments, five quiet acoustical condition programs Q1-Q5 are available to try in this mode. To cycle through the available quiet acoustical condition programs, the user presses and quickly releases the rocker switch up control 34*a* or down control 34*b* (step 604). When switching from one Q-program to the next, the audio output section 19 emits an auditory indicator of the active program, such as some number of pure-tone beeps indicating the number of the program. The user can select one of the programs Q1-Q5 to be designated as a selected or preferred program by pressing and holding the rocker switch up control 34*a* or down control 34*b* for some extended time, such as ten seconds (step 606). The selected quiet condition program is referred to as a QS program. At this point a long tone sounds to indicate to the user that the QS program is selected (step 608).

Once the QS program is selected, the non-selected Q-programs are deactivated. In preferred embodiments, the non-selected Q-programs are not erased, but are available for reactivation by resetting the device using the Configuration Mode described below.

After selection of the QS program, the processor 16 (FIG. 11) enters a noise program selection mode 610. In preferred embodiments, five noise acoustical condition programs QS and N1-N5 are available to try. To cycle through the available noise acoustical condition programs, the user presses and quickly releases the rocker switch up control 34*a* or down control 34*b* (step 612). When switching from one N-program to the next, the audio output section 19 emits an auditory indicator of the active program, such as some number of white noise sounds indicating the number of the program. The user can select one of the programs N1-N5 to be designated as a selected or preferred program by pressing and holding the rocker switch up control 34*a* or down control 34*b* for some extended time, such as ten seconds (step 614). The selected noise condition program is referred to as the NS program. At this point a long white noise sound is produced to indicate to the user that the NS program is selected (step 616) and the processor 16 enters a daily use mode 618.

As in other embodiments described herein, the telecoil program TS is automatically selected based on the selection of the QS program, with the selection of program T1-T5 corresponding to the selection of program Q1-Q5. For example, if QS=Q5, then TS=T5. While in the daily use mode 618, the selected programs QS, NS and TS are loaded from memory 26 (step 620) and the user can switch between the programs QS, NS and TS by pressing and quickly releasing the rocker switch up control 34*a* or down control 34*b* (step 622). If the QS program is selected, a pure-tone beep is emitted from the audio output section 319. If the NS program is selected, a noise pulse is emitted. If the TS program is selected, a dial-tone pulse is emitted.

While in the daily use mode or when a program has been selected, the user can increase the audio volume by pressing and holding the rocker switch up control 34*a* (step 624) and decrease the audio volume by pressing and holding the rocker switch down control 34*b* (step 626).

Figure 13:
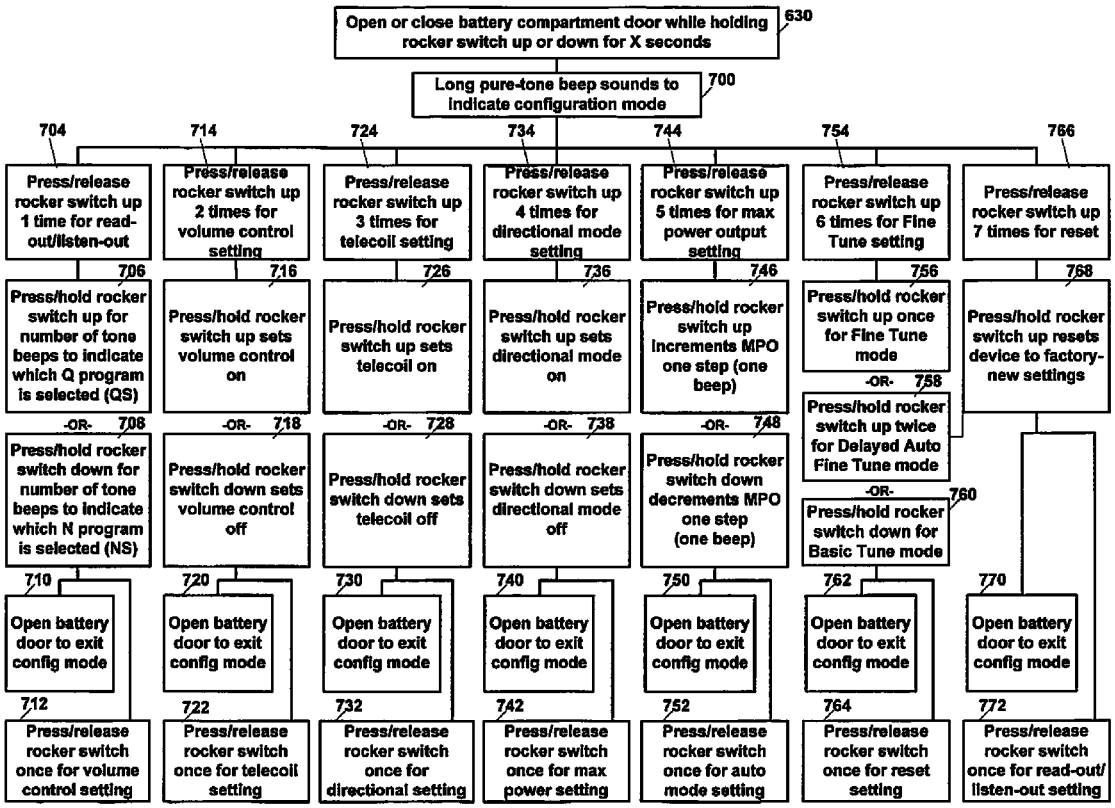
FIG. 13 depicts a state diagram for a configuration mode of a hearing assistance device according to an embodiment of the invention.

As shown in FIGS. 12 and 13, the device 10 enters the Configuration Mode 628 when the user presses the rocker switch up control 34*a* or down control 34*b* while closing the battery compartment door and continues to press the rocker switch up control 34*a* or down control 34*b* for some extended time, such as 20 seconds (step 630). A long pure-tone beep sounds to indicate the device has entered the Configuration Mode. Once in the Configuration Mode, the device option to be configured may be selected based on how many consecutive times the rocker switch up control 34*a* or down control 34*b* is pressed (step 632). Each press of the rocker switch up control 34*a* or down control 34*b* will step to a next configuration option in a sequence of options, and will eventually wrap around and start through the sequence again when the last configuration option is passed. The Configuration Mode may be exited by opening the battery compartment door (step 634).

As shown in FIG. 13, while in the Configuration Mode, if the user presses and quickly releases the rocker switch up control 34*a* or down control 34*b* only once after entering the configuration mode, the "Read-out/Listen-out" option is selected (step 704). Using this option, the audiologist/dispenser or user can determine which of the fifteen quiet environment condition programs (Q1-Q5 and two fine-tuning programs QSL-QSH for each program Q1-Q5) is the current selected QS program and which of the fifteen noisy environment condition programs (N1-N5 and two fine-tuning programs NSL-NSH for each program N1-N5) is the current selected NS program. If the rocker switch up control 34*a* is pressed and held for some extended time, such as 10 seconds, some number of tone beeps are sounded to indicate which of the fifteen quiet-environment programs is the current selected QS program (step 706). For example, if the program Q3 is the selected QS program, then three tone beeps may be sounded. Likewise, if the rocker switch down control 34*b* is pressed and held for some extended time, such as 10 seconds, some number of tone beeps are sounded to indicate which of the fifteen noisy-environment programs is the current selected NS program (step 708). If the battery compartment door is opened, the device exits the Configuration Mode (step 710). If the user presses and quickly releases the rocker switch up control 34*a* or down control 34*b* once while the "Read-out/Listen-out" option is selected, then the "Volume Control Setting" option is selected (step 712).

If the user presses and quickly releases the rocker switch up control 34*a* or down control 34*b* only twice after entering the Configuration Mode, the "Volume Control Setting" option is selected (step 714). Using this option, the user can control whether the volume control will be activated or deactivated when the device is next operated in the standard daily use mode. If the rocker switch up control 34*a* is pressed and held for some extended time, such as 10 seconds, the volume control will be activated (step 716). Likewise, if rocker switch down control 34*b* is pressed and held for some extended time, such as 10 seconds, the volume control will be deactivated (step 718). If the battery compartment door is opened, the device exits the Configuration Mode (step 720). If the user presses and quickly releases the rocker switch up control 34*a* or down control 34*b* once while the "Volume Control Setting" option is selected, then the "Telecoil Setting" option is selected (step 722).

If the user presses and quickly releases the rocker switch up control 34*a* or down control 34*b* only three times after entering the Configuration Mode, the "Telecoil Setting" option is selected (step 724). Using this option, the user can control whether the telephone coil 30 (FIG. 11) will be activated or deactivated when the device 10 is next operated in the standard daily use mode. If the rocker switch up control 34*a* is pressed and held for some extended time, such as 10 seconds, the telephone coil 30 will be activated (step 726). Likewise, if the rocker switch down control 34*b* is pressed and held for some extended time, such as 10 seconds, the telephone coil 30 will be deactivated (step 728). If the battery compartment door is opened, the device exits the Configuration Mode (step 730). If the user presses and quickly releases the rocker switch up control 34*a* or down control 34*b* once while the "Telecoil Setting" option is selected, then the "Directional Mode Setting" option is selected (step 732).

If the user presses and quickly releases the rocker switch up control 34*a* or down control 34*b* only four times after entering the Configuration Mode, the "Directional Mode Setting" option is selected (step 734). Using this option, the user can control whether the Directional Mode is activated in which the device uses two microphones, or deactivated so that the device uses a single microphone. If the rocker switch up control 34*a* is pressed and held for some extended time, such as 10 seconds, the directional mode will be activated (step 736). Likewise, if the rocker switch down control 34*b* is pressed and held for some extended time, such as 10 seconds, the directional mode will be deactivated (step 738). If the battery compartment door is opened, the device exits the Configuration Mode (step 740). If the user presses and quickly releases the rocker switch up control 34*a* or down control 34*b* once while the "Directional Mode Setting" option is selected, then the "Maximum Power Output Setting" option is selected (step 742).

If the user presses and quickly releases the rocker switch up control 34*a* or down control 34*b* only five times after entering the configuration mode, the "Maximum Power Output Setting" option is selected (step 744). Using this option, the audiologist/dispenser or user can control the maximum output power level of the audio section 19 (FIG. 11). Each time the rocker switch up control 34*a* is pressed and held for some extended time, such as 10 seconds, the maximum power output level is incremented one step and one beep sounds (step 746). Each time the rocker switch down control 34*b* is pressed and held for some extended time, such as 10 seconds, the maximum power output level is decremented one step and one beep sounds (step 748). If the battery compartment door is opened, the device exits the Configuration Mode (step 750). If the user presses and quickly releases the rocker switch up control 34*a* or down control 34*b* once while the "Maximum Power Output Setting" option is selected, then the "Fine Tuning" option is selected (step 752).

If the user presses and quickly releases the rocker switch up control 34*a* or down control 34*b* only six times after entering the configuration mode, the "Fine Tuning" option (also referred to herein as Auto Mode option) is selected (step 754).

Using this option, the user can control how and when the device may be fine tuned by accessing additional acoustic algorithms that are approximately 2 dB above (referred to as QSH and NSH) and 2 dB below (referred to as QSL and NSL) the primary quiet and noise environment algorithms. When the Fine Tuning option is selected, the user can activate the Fine Tune mode by pressing and holding the rocker switch up control 34*a* once for some extended time, such as 10 seconds (step 756). Two beeps will sound to indicate that the Fine Tune mode is active. The user can activate the Delayed Automatic Fine Tune mode by pressing and holding the rocker switch up control 34*a* twice for some extended time, such as 10 seconds (step 758). Three beeps will sound to indicate that the Delayed Automatic Fine Tune mode is active. The user can activate the Basic Tune mode by pressing and holding the rocker switch down control 34*a* once for some extended time, such as 10 seconds (step 760). One beep will sound to indicate that the Basic Tune mode is active. If the battery compartment door is opened, the device exits the Configuration Mode (step 762). If the user presses and quickly releases the rocker switch up control 34*a* or down control 34*b* once while the "Fine Tuning" option is selected, then the "Reset" option is selected (step 764).

Examples of operation in the Fine Tune mode and Delayed Automatic Fine Tune mode have been described hereinabove in reference to FIG. 9A (FT_State). The Fine Tune mode is preferred for allowing an audiologist to fine tune the device 10 while fitting the device 10 to a patient. With the Delayed Automatic Fine Tune mode, the device 10 automatically performs the fine tuning process after the device 10 has been used by a patient for some elapsed time, such as 15 or 30 days. Various methods of determining the elapsed time are described hereinabove. In the Basic Tune mode, the additional fine tuning programs are not made available.

If the user presses and quickly releases the rocker switch up control 34*a* or down control 34*b* only seven times after entering the Configuration Mode, the "Reset" option is selected (step 766). Using this option, the user can reset the device to its factory settings by pressing and holding the rocker switch up control 34*a* for some extended time, such as 10 seconds (step 768). If the battery compartment door is opened, the device exits the Configuration Mode (step 770). If the user presses and quickly releases the rocker switch up control 34*a* or down control 34*b* once while the "Reset" option is selected, then the device cycles back to the "Read-out/Listen-out Setting" option (step 772).

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A programmable apparatus for improving perception of sound by a person, the apparatus comprising:

one or more housings configured to be worn in, on or behind an ear of the person;

a battery compartment door attached to at least one of the one or more housings;

at least one contact switch which changes state based on opening or closing the battery compartment door;

memory disposed within at least one of the housings, the memory for storing a plurality of available audio processing programs that may be used in processing digital audio signals;

a processor disposed within at least one of the housings and connected to the memory, the processor operable to execute one or more of the available audio processing programs to process the digital audio signals;

a multipurpose control device disposed on one of the housings and connected to the processor, the multipurpose control device for operating in a program switching mode in which the multipurpose control device is operable by the person to switch from one of the available audio processing programs to another of the available audio processing programs, the multipurpose control device further for operating in a volume control mode in which the multipurpose control device is operable by the person to adjust the volume of audible sound generated by an audio output section, the multipurpose control device further operable by the person to change configuration settings of the programmable apparatus when the processor is in a configuration mode;

the processor further operable in the configuration mode for changing configuration settings of the programmable apparatus, wherein the processor is operable to enter the configuration mode when the at least one contact switch of the battery compartment door indicates the battery compartment door is moved from an open position to a closed position while the multipurpose control device is continuously operated by the person for a predetermined time;

a digital-to-analog converter disposed within at least one of the housings, the digital-to-analog converter for generating output analog audio signals based on the digital audio signals; and the audio output section disposed within at least one of the housings, the audio output section for receiving and amplifying the output analog audio signals, generating audible sound based thereon and providing the audible sound to the person.

2. The programmable apparatus of claim 1 wherein the multipurpose control device comprises a digital rocker switch.

3. A method for controlling a hearing assistance device disposed in a housing having a battery compartment door, wherein the hearing assistance device has a single multipurpose control device having an up control and a down control, a controller for sensing states of the up control and down control and for sensing open or closed states of the battery compartment door, and a processor for operating in a configuration mode and in one or more other operational modes, wherein the processor is operable to execute a configuration control routine selected from a plurality of configuration control routines while in the configuration mode, the method comprising:

(a) pressing the up control or the down control continuously for an extended time while closing the battery compartment door;

(b) the controller sensing the up control or down control being pressed continuously for at least a predetermined time during and after the closing of the battery compartment door;

(c) the controller generating a first control signal based on step (b);

(d) the processor entering the configuration mode based on the first control signal;

(e) the controller sensing the opening and closing of the battery compartment door;

(f) the controller generating a second control signal based on step (e); and (g) the processor exiting the configuration mode and entering one of the other operational modes based on the second control signal.

4. The method of claim 3 wherein between steps (d) and (e) the method further includes:

(d1) pressing and releasing the up control or the down control a number of times to select one of the plurality of configuration control routines;

(d2) the controller sensing the up control or the down control being pressed and released the number of times;

(d3) the processor determining which one of the plurality of configuration control routines to execute based on the number of times the up control or the down control is pressed and released; and (d4) the processor executing the configuration control routine determined in step (d3).

5. The method of claim 3 wherein between steps (d) and (e) the method further includes pressing and holding the up control or the down control to change a configuration control setting while the processor executes a selected configuration control routine.

6. A programmable apparatus for improving perception of sound by a person, the apparatus comprising:

one or more housings configured to be worn in, on or behind an ear of the person;

memory disposed within at least one of the housings, the memory for storing a plurality of available audio processing programs that may be used in processing digital audio signals;

at least one contact switch which changes state based on opening or closing a battery compartment door on the one or more housings;

a processor disposed within at least one of the housings and connected to the memory, the processor operable to execute one or more of the available audio processing programs to process the digital audio signals, the processor further operable in a configuration mode for changing configuration settings of the programmable apparatus, wherein the processor is operable to enter the configuration mode when the at least one contact switch changes state based on an action performed by the person;

a multipurpose control device disposed on one of the housings and connected to the processor, the multipurpose control device for operating in a program switching mode in which the multipurpose control device is operable by the person to switch from one of the available audio processing programs to another of the available audio processing programs, the multipurpose control device further for operating in a volume control mode in which the multipurpose control device is operable by the person to adjust the volume of audible sound generated by an audio output section, the multipurpose control device further for operating in the configuration mode in which the multipurpose control device is operable by the person to change configuration settings of the programmable apparatus;

a digital-to-analog converter disposed within at least one of the housings, the digital-to-analog converter for generating output analog audio signals based on the digital audio signals; and the audio output section disposed within at least one of the housings, the audio output section for receiving and amplifying the output analog audio signals, generating audible sound based thereon and providing the audible sound to the person.

7. A method for controlling a hearing assistance device disposed in a housing having a battery compartment door, wherein the hearing assistance device has a single multipurpose control device having an up control and a down control, a controller for sensing states of the up control and down control and for sensing open or closed states of the battery compartment door, and a processor for operating in a configuration mode and in one or more other operational modes, wherein the processor is operable to execute a configuration control routine selected from a plurality of configuration control routines while in the configuration mode, the method comprising:

(a) pressing the up control or the down control continuously for an extended time while closing the battery compartment door;

(b) the controller sensing the up control or down control being pressed continuously for at least a predetermined time during and after the closing of the battery compartment door;

(c) the controller generating a first control signal based on step (b); and (d) the processor entering the configuration mode based on the first control signal.

* * * * *